US005449239A

United States Patent [19]

Koshiishi et al.

[11] Patent Number: 5,449,239

[45] Date of Patent: Sep. 12, 1995

[54] IMPACT DOT HEAD WITH RESILIENTLY MOUNTED WIRE GUIDE

[75] Inventors: Osamu Koshiishi; Takashi Asada; Masaki Shimomura; Minoru Tanaka, all of Nagano, Japan

[73] Assignee: Seiko Epson Corporation, Tokyo, Japan

[21] Appl. No.: 95,645

[22] Filed: Jul. 21, 1993

[30] Foreign Application Priority Data

| | | | |
|---|---|---|---|
| Jul. 21, 1992 | [JP] | Japan | 4-194114 |
| Oct. 6, 1992 | [JP] | Japan | 4-267610 |
| Oct. 6, 1992 | [JP] | Japan | 4-267613 |

[51] Int. Cl.[6] ..... B41J 2/265

[52] U.S. Cl. ..... 400/124.27; 400/124.24

[58] Field of Search ..... 400/124, 124 VI, 124 GT; 101/93.05

[56] References Cited

U.S. PATENT DOCUMENTS

| | | | |
|---|---|---|---|
| 3,833,105 | 9/1974 | Howard | 400/124 |
| 3,929,214 | 12/1975 | Hebert | 400/124 |
| 4,248,147 | 2/1981 | Zenner | 400/124 |
| 4,470,713 | 9/1984 | Rossopoulos | 400/124 |
| 4,501,506 | 2/1985 | Weeks et al. | 400/124 |
| 4,662,764 | 5/1987 | Cavallari | 400/124 |
| 4,950,092 | 8/1990 | Kikuchi et al. | 400/124 |
| 5,048,985 | 9/1991 | Mitsuishi et al. | 400/124 |
| 5,193,922 | 3/1993 | Hayashi | 400/124 |

FOREIGN PATENT DOCUMENTS

| | | | |
|---|---|---|---|
| 230813 | 10/1959 | Australia | 400/124.24 |
| 77583 | 5/1982 | Japan | 400/124.24 |
| 43574 | 3/1986 | Japan | 400/124.24 |
| 190462 | 7/1989 | Japan | 400/124.27 |
| 80255 | 3/1990 | Japan | 400/124.24 |
| 998139 | 2/1983 | U.S.S.R. | 400/124.27 |

OTHER PUBLICATIONS

"Displaceable Print Wire Guide"; *IBM Tech Disc Bull;* R. J. Harri, vol. 26, No. 8, Jan. 1984, p. 3985.

*Primary Examiner*—David A. Wiecking

*Attorney, Agent, or Firm*—Stroock & Stroock & Lavan

[57] ABSTRACT

Disclosed is an impact dot head and an impact dot printer provided as not causing wire breakage by supporting a wire performing a printing operation so as to be resiliently oscillatable in a printing digit direction even if the impact dot head starts printing from a position outside a printing sheet due to erroneous setting of a printing area and therefore passes an end of the printing sheet while performing the printing operation.

27 Claims, 31 Drawing Sheets

PRIOR ART

⇨ MOVEMENT DIRECTION OF THE IMPACT DOT HEAD

IMPACT DOT HEAD WITH RESILIENTLY MOUNTED WIRE GUIDE

BACKGROUND OF THE INVENTION

1. Field of the Invention

The invention relates to impact dot heads for impact dot matrix printers. More particularly, the invention is directed to an impact dot head that can prevent breakage of wires by arranging the wires so as to be resiliently oscillatable in a printing digit direction.

2. Related Art

An exemplary conventional impact dot head is shown in FIGS. 54 and 55. As shown in FIG. 54, an impact dot head is designed to form a dot by projecting a wire 8 and applying impact onto a printing sheet 19 on a platen 12 through an ink ribbon 21 while moving in a direction parallel with the platen 12 (the direction perpendicular to the surface of the sheet in FIG. 54). In order to form a dot at a predetermined position on the printing sheet 19, each wire 8 is supported while arranged so as to be oscillatable by intermediate guides 7 and a front end guide 6.

A method of mounting the front end guide 6 has been proposed in Japanese Patent Unexamined Publication No. 530/1990. This impact dot head is provided as securing the front end guide 6 by inserting the front end guide 6 and the intermediate guides 7 into a nose guide 18 as shown in FIG. 55. Further, the nose guide 18 is secured by being inserted into a nose 1 made of a metal. The nose 1 has an oval window portion 30 that can accommodate the nose guide 18 with the front end guide 6 being secured thereto. The front end guide 6 is positioned by front end guide grooves 23 of the nose guide 18 in a direction perpendicular to the printing sheet and by the oval window portion 30 of the nose 1 in a direction parallel with the printing sheet.

The thus arranged impact dot head 400 is, as shown in FIGS. 56 and 57, fixed on a carriage 401 by fitting projecting portions 403 arranged on the carriage 401 into mounting holes 402 arranged on the nose 1 and screwing them.

In a conventional impact dot printer, when printing is started from a position outside a printing sheet due to erroneous setting of a printing area, the wire 8 gets broken as the impact dot head passes the end of the printing sheet while performing the printing operation. Amid diversification of printing paper, printing tends to be performed on thick paper or thick multi-sheet printing paper such as a duplicating slip, and the printing on such thick paper has often caused the trouble of wire breakage at the end of the printing sheet, which is a problem to be overcome.

How the wire gets broken when the impact dot head passes the end of the printing sheet while performing the printing operation will be described below.

FIG. 58 is a cutaway plan view of FIG. 54 as viewed from a position F. As shown in FIG. 58, the impact dot head starts printing at a position outside the printing sheet 19. When the head passes the end of the printing sheet 19 with the wire 8 driven to project while moving from left to right as viewed in FIG. 58, the wire 8 collides against the end of the printing sheet 19 and receives a force A. As a result, the wire 8 is flexed and receives a reaction B from a guide hole 32 arranged on the front end guide 6. If it is supposed that the frictional coefficient between the wire 8 and the ink ribbon 21 is $\alpha$ and the frictional coefficient between the wire 8 and the front end guide 6 is $\beta$, then frictional forces C and D act on the wire 8 in a direction opposite to a direction in which the wire 8 returns (the direction indicated by an arrow X). These frictional forces C ($=\alpha A$) and D ($=\beta B$) impede the wire 8 from returning. Therefore, the impact dot head continuously moves from left to right as viewed in FIG. 58 with the wire 8 having projected, which causes the wire 8 to be further flexed. As a result, when the bending stress of the wire 8 exceeds the allowable stress, the wire 8 gets broken, which makes normal printing impossible thereafter because there are missing dots.

While a case where the printing operation is performed from the position outside the left end of the printing sheet to right has been described, the same holds true for a case where printing is done from a position outside the right end of the printing sheet to left.

As a method of avoiding wire breakage applied to the conventional impact dot head, it is conceivable to significantly increase the returning force of a return spring 15 shown in FIG. 54 so as to exceed the sum of the frictional forces C and D. However, if the returning force of the return spring 15 is increased so much, a printing force large enough to overcome such large returning force must be obtained, which entails an extremely large drive current. That is, if the returning force of the return spring 15 is increased to a significant degree, the power capacity must be increased. In addition, an increase in the drive current results in building up heat in the head.

Therefore, the problem of wire breakage caused at the time the impact dot head passes the end of the printing sheet during printing has been substantially unavoidable.

SUMMARY OF THE INVENTION

The invention has been made to overcome the above-described conventional problems. Accordingly, the object of the invention is to provide an impact dot head and an impact dot printer free from wire breakage even if the printing operation is started from a position outside a printing sheet due to erroneous setting of a printing area and the impact dot head has passed the end of the printing sheet while performing the printing operation.

An impact dot head of the invention is provided as supporting a wire that prints while moving in a printing digit direction so as to be resiliently oscillatable in a printing digit direction. The structure for supporting the wire resiliently and oscillatably in the printing digit direction is such that: a nose guide oscillatably supporting the wire is supported so as to be oscillatable in the printing digit direction; and the nose guide is biased by a biasing means so that the nose guide is positioned in the middle of a nose. The structure may also have: a front end guide for oscillatably supporting the wire; a nose for supporting the front end guide so as to be movably in the printing digit direction; and a biasing means for biasing the front end guide so that the front end guide is positioned in the middle of the nose. Further, the structure may be such that the nose for oscillatably supporting the wire has resiliency itself and is oscillatable in the printing digit direction.

An impact dot printer of the invention is designed so that the impact dot head is supported by a carriage so as to be resiliently oscillatable in the printing digit direction.

DETAILED DESCRIPTION OF THE PREFERRED EMBODIMENTS

Embodiments of the invention will now be described with reference to the accompanying drawings.

Figure 1:
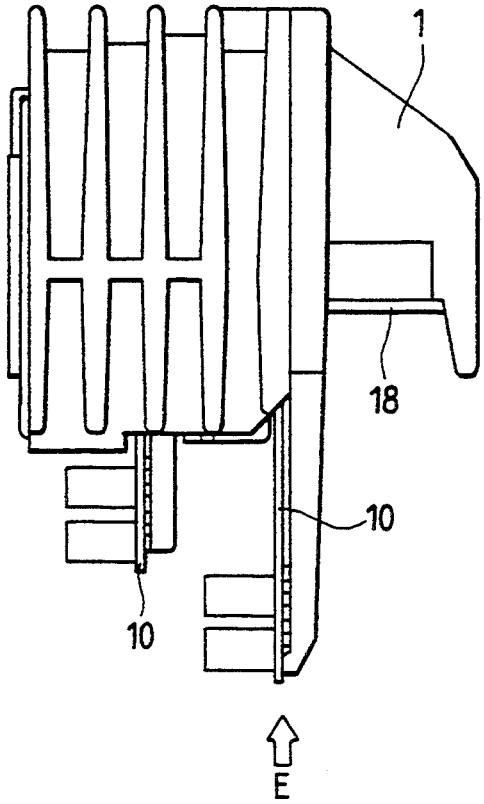
FIG. 1 is a side view showing an impact dot head, which is a first embodiment of the invention.
Figure 2:
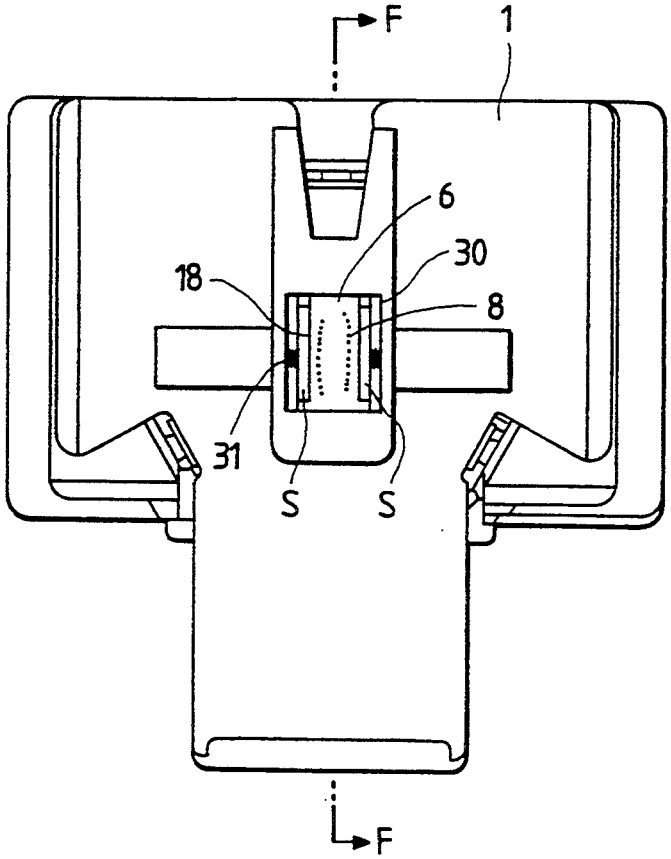
FIG. 2 is a front view thereof.
Figure 3:
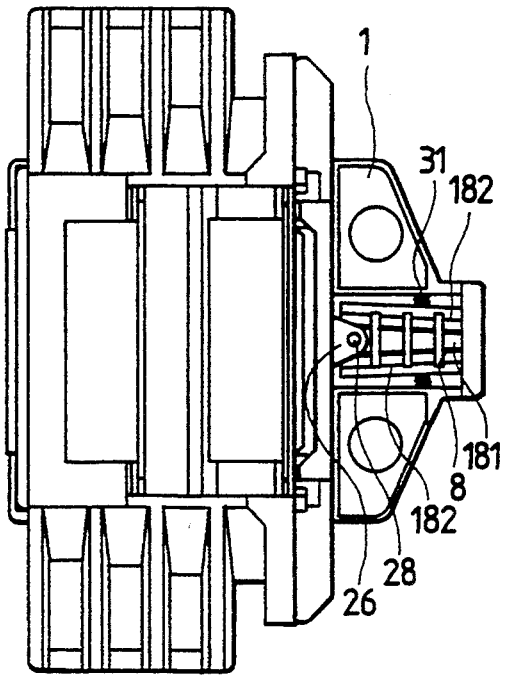
FIG. 3 is a plan view of FIG. 1 as viewed from a position E.
Figure 4:
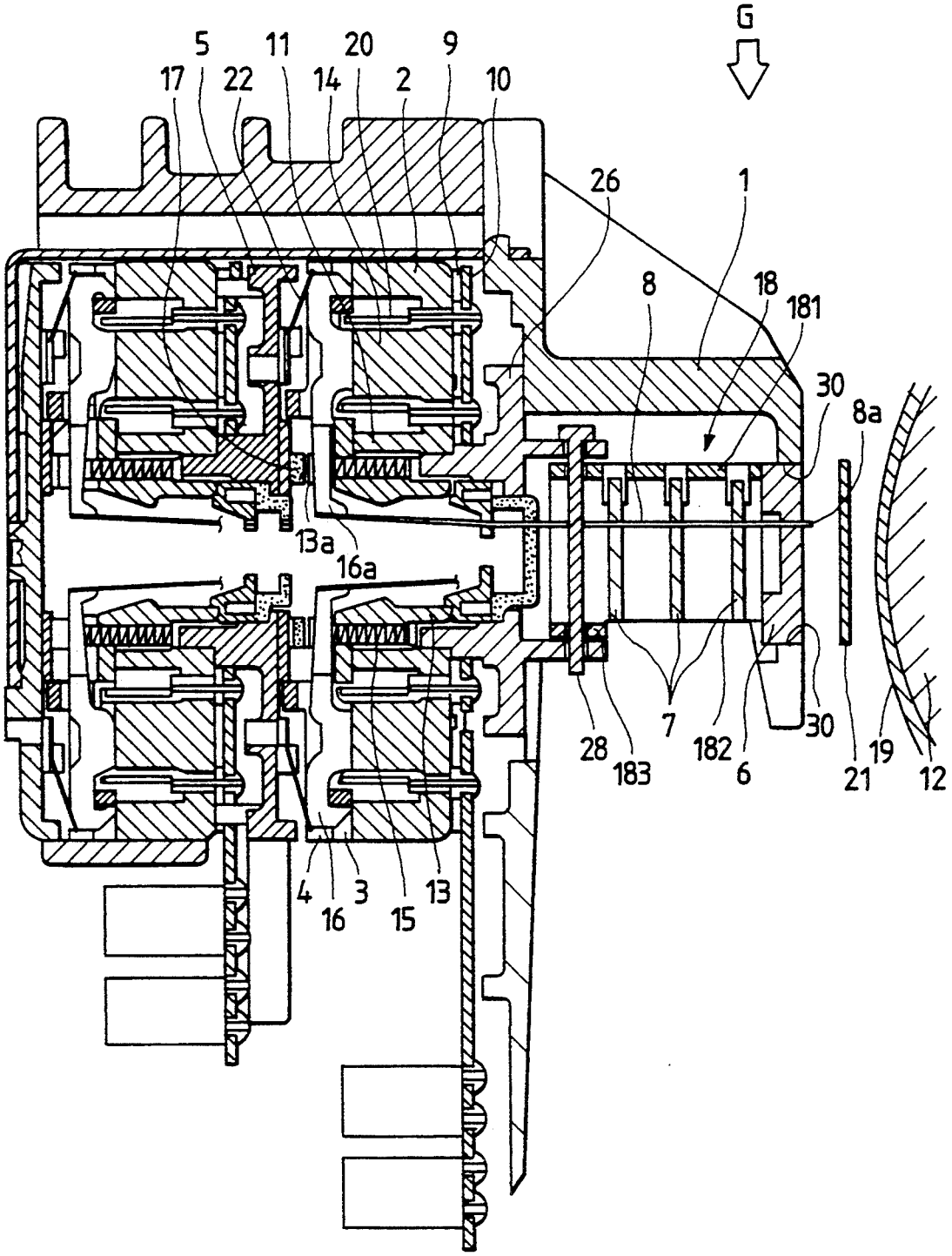
FIG. 4 is a sectional view taken along a line F—F of FIG. 2.

FIG. 1 is a side view showing an impact dot head, which is a first embodiment of the invention; FIG. 2 is a front view thereof; FIG. 3 is a plan view of FIG. 1 as viewed from a position E; and FIG. 4 is a sectional view taken along a line F—F of FIG. 2.

As shown in these drawings (mainly in FIG. 4), on a frame of the main body of the impact dot head is a printed wiring board 10 arranged through an insulating member 9. The frame 2 is cylindrical in shape. A plurality of frame core portions 14 stand up in parallel with one another from the bottom surface of the frame 2. Coils 20 are wound around these frame core portions 14. Each coil 20 is connected to the printed wiring board 10. A spring holder 13 is mounted on an inner circumferential ring portion 11 of the frame 2. A plurality of return springs 15 whose number corresponds to the number of the frame core portions 14 are arranged on the spring holder 13. A guide groove 13*a* arranged on the spring holder 13 guides a front end portion 16*a* of a lever 16. On the upper surface of the frame 2 (on the left side as viewed in FIG. 4) are a first yoke 3 and a second yoke 4. The first yoke 3 and the second yoke 4 are designed to position the lever 16 that confronts the frame core portions 14. Wires 8 are secured to the front ends of these levers 16 and biased by the return springs 15 in a return direction (leftward as viewed in FIG. 4). Front end portions 8*a* of the wires 8 are arrayed at predetermined positions. Further, a damper holder 5 is mounted while abutted against the upper surface (on the left side as viewed in FIG. 4) of the spring holder 13. A damper 17 is mounted in the middle of the damper holder 5. The back surface of a front end of the lever 16 is abutted against the dumper 17. A fulcrum biasing spring 22 is arranged on the dumper holder 5, so that the fulcrum of the lever 16 can be supported resiliently.

In such arrangement, the coils 20 connected to the printed wiring board 10 are selectively energized in accordance with a printing signal, and the magnetic flux induced by the coil 20 forms a closed loop consisting of the frame core portion 14, the frame 2, the first yoke 3, the second yoke 4, and the lever 16. Accordingly, an electromagnetic attracting force is produced between the frame core portion 14 and the lever 16, which then causes the lever 16 to advance. As a result, the wire 8 secured to the front end of the lever 16 gives impact on a printing sheet 19 placed on a platen 12 through an ink ribbon 21, whereby a dot is formed. After having formed the dot, the lever 16 starts the return operation by the force of the return spring 15, colliding against the dumper 17 supported by the dumper holder 5 to return to the stand-by position.

The structure for supporting the wire 8 oscillatably and resiliently in the printing digit direction, which is a feature of the invention, will be described below.

Figure 5:
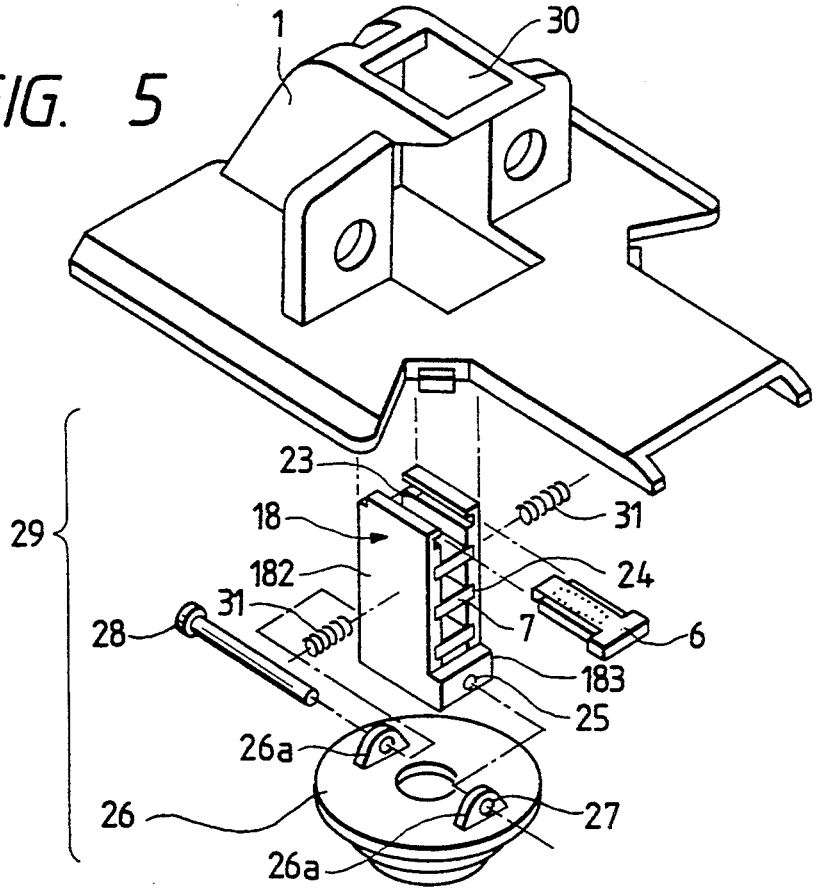
FIG. 5 is an exploded perspective view showing a nose guide portion and a nose.

FIG. 5 is an exploded perspective view showing a nose guide portion and a nose.

As mainly shown in FIGS. 4 and 5, a nose guide 18 has: a pair of side plates 182; a top plate 181 coupling the top portions of the side plates 182; and a bottom plate 183 coupling the rear end bottom portions of the side plates 182. A front guide groove 23 is arranged on the nose guide 18, the front end guide groove 23 holding a front end guide 6. The front end guide 6 oscillatably supports the wires 8 and arranges the front ends of the wires 8 at predetermined positions (see FIGS. 2 and 4). Further, the nose guide 18 has intermediate guide grooves 24 so as to hold intermediate guides 7. Each intermediate guide 7 oscillatably supports the middle portions of the wires. On the rear end portion of the nose guide 18 are vertically extending through holes 25. A nose guide base 26 has bearing portions 26*a* that project at the upper and lower sides of the nose guide 18. Each bearing portion 26*a* has a hole 27 corresponding to the holes 25 of the nose guide 18. The nose guide 18 and the nose guide base 26 are oscillatably combined by inserting a pin-like shaft 28 into the holes 25 and the holes 27. A nose guide unit 29 formed by combining the nose guide 18 and the nose guide base 26 is inserted into the nose 1 fixed on the main body with the nose guide base 26 being fixed while interposed between the nose 1 and the frame 2. At this point, the front end guide 6 held by the nose guide 18 is inserted into a window portion 30 of the nose 1. The window portion 30 only guides the upper and lower ends of the front end guide 6 slidably. Thus, a gap S is formed on each of the right and left ends of the front end guide 6 relative to the window portion 30 of the nose 1 (see FIG. 2). Coil springs 31 are arranged on both right and left sides, each being interposed between the side surface of the nose guide 18 and the inner surface of the nose 1. These coil springs 31 resiliently support the nose guide 18 so that the front end guide 6 can be positioned in the middle of the window portion 30 of the nose 1 under the normal condition as shown in FIGS. 2 and 3 and so that the nose guide 18 can oscillate in the right and left directions as viewed in FIG. 2, i.e., in the printing digit direction.

Figure 6:
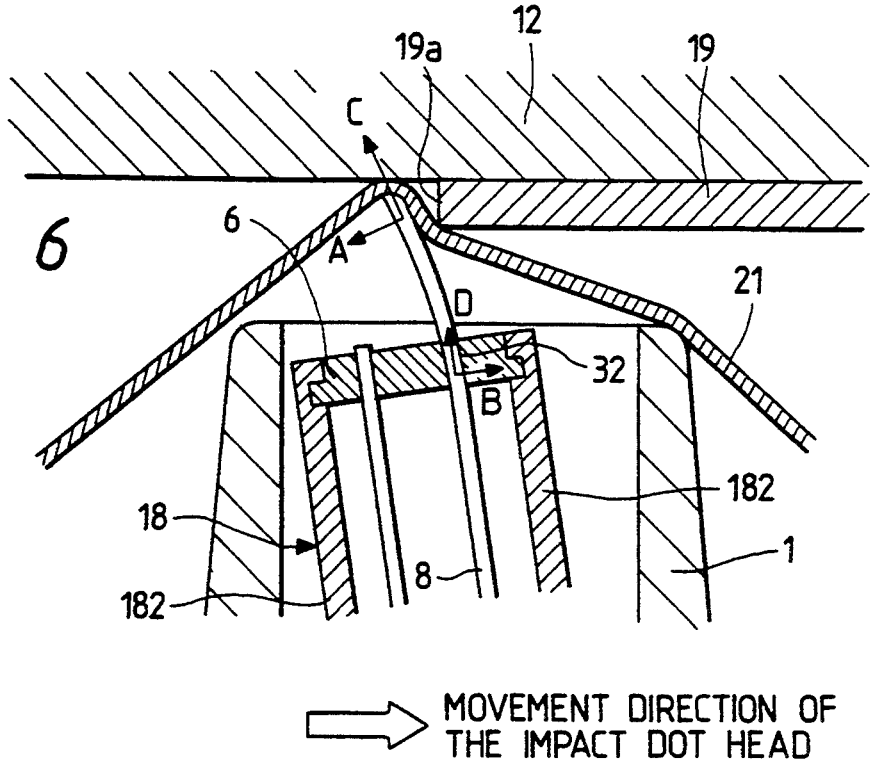
FIG. 6 is a sectional plan view of FIG. 4 as viewed from a position G.

A case where a printer having the thus constructed impact dot head makes an erroneous printing will be described with reference to FIG. 6. More specifically, the case is that the impact dot head starts printing from a position outside a printing sheet 19 due to erroneous setting of a printing area and passes an end of the printing sheet 19 while performing the printing operation. FIG. 6 is a sectional plan view of FIG. 4 as viewed from a position G.

The impact dot head moves in the direction of arrow Z. When the impact dot head starts printing at a position outside the printing sheet 19 and passes the end of the printing sheet 19 with the wire 8 projecting while moving from left to right as viewed in FIG. 6, the wire 8 receives a force A while colliding against the end 19*a* of the printing sheet 19. As a result, the wire 8 biases a guide hole 32 arranged on the front end guide 6 leftward, whereas the wire 8 receives a reaction B thereagainst. The biased front end guide 6 deforms the coil springs 31 (see FIGS. 2, 3 and 5) through the nose guide 18, causing the nose guide 18 to make an angular displacement around the shaft 28. If it is supposed that the frictional coefficient between the wire 8 and the ink ribbon 21 is $\alpha$ and the frictional coefficient between the wire 8 and the front end guide 6 is $\beta$, then frictional forces C ($=\alpha A$) and D ($=\beta B$) act in a direction opposite to the direction of movement of the wire 8, i.e., the direction hampering the returning operation of the wire. However, the angular displacement of the nose guide 18 decreases forces A and B, thereby decreasing the frictional forces C and D. Therefore, the wire 8 can be returned to the stand-by position without being broken even if the impact dot head passes the end of the printing sheet 19 with the wire 8 projecting.

On the other hand, after the head has passed the end of the printing sheet 19, the nose guide 18 is returned to the center of the window portion 30 of the nose 1 by the coil springs 31, so that the wire 8 returns to a predetermined position and thus the high-quality printing similar to the conventional impact dot head can be maintained.

The front end guide may preferably be made of materials whose frictional coefficient is low, such as polyacetal, polypropylene, resins incorporated with tetrafluoethylene fiber, or oleo-resins. The reason is that a small frictional coefficient $\beta$ can decrease the frictional force D further, which contributes to implementing the impact dot head with a high wire breakage resistance.

Figure 7:
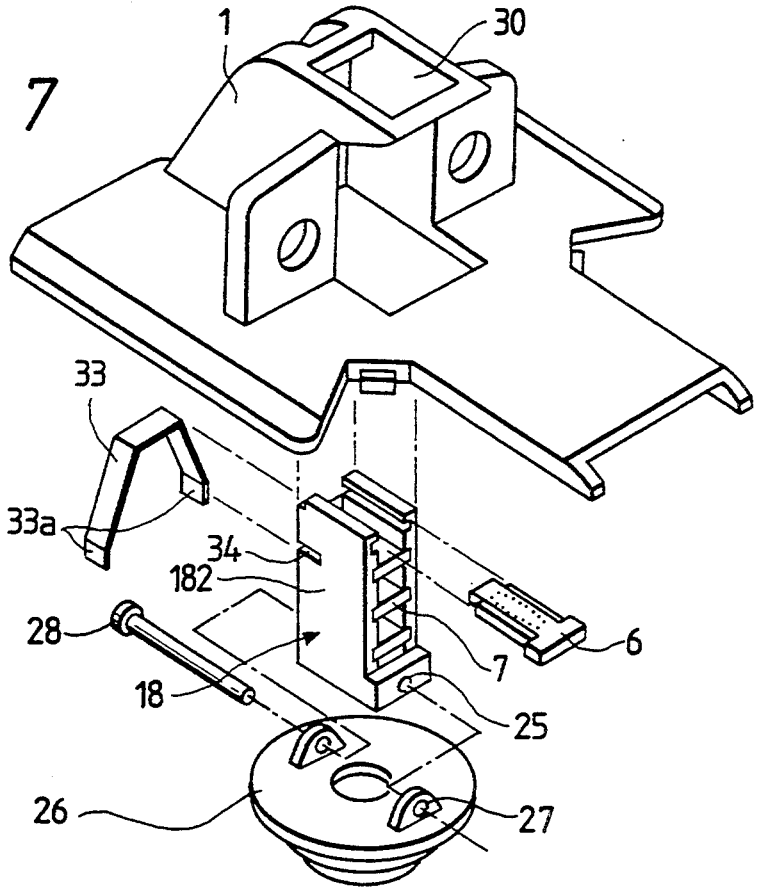
FIG. 7 is an exploded perspective view showing a modified example.

FIG. 7 shows a modified example, in which the coil springs 31 are replaced by a plate spring 33. The plate spring 33 is fixed by being fitted into a groove portion 34 arranged on the nose guide 18. Front ends 33*a*, 33*a* of the plate spring 33 are designed to abut against the inner surfaces of the nose 1.

Such structure is simpler than the one with the coil springs 31, thus improving the assembling ease.

Figure 8:
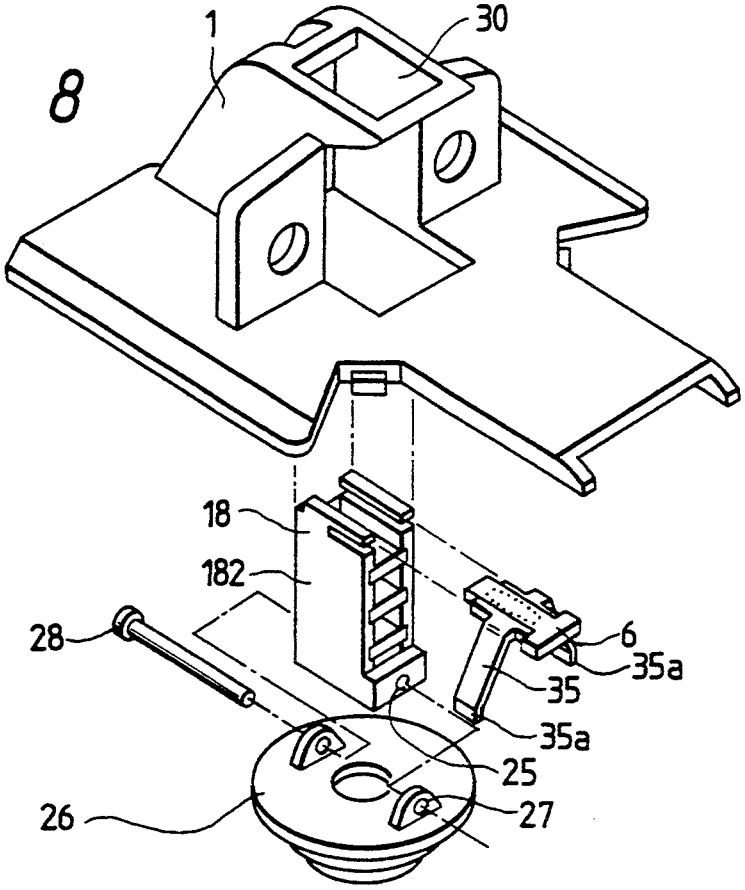
FIG. 8 is an exploded perspective view showing a modified example.

FIG. 8 shows another modified example, in which resilient arms 35, 35 integrally formed with the front end guide 6 are used instead of the coil springs 31. Front ends 35*a*, 35*a* of the resilient arms 35 are designed to abut against the inner surfaces of the nose 1. In this modified example, the front end guide 6 and the resilient arms 35 are formed integrally, so that the dimensional control of the parts can be facilitated.

Figure 9:
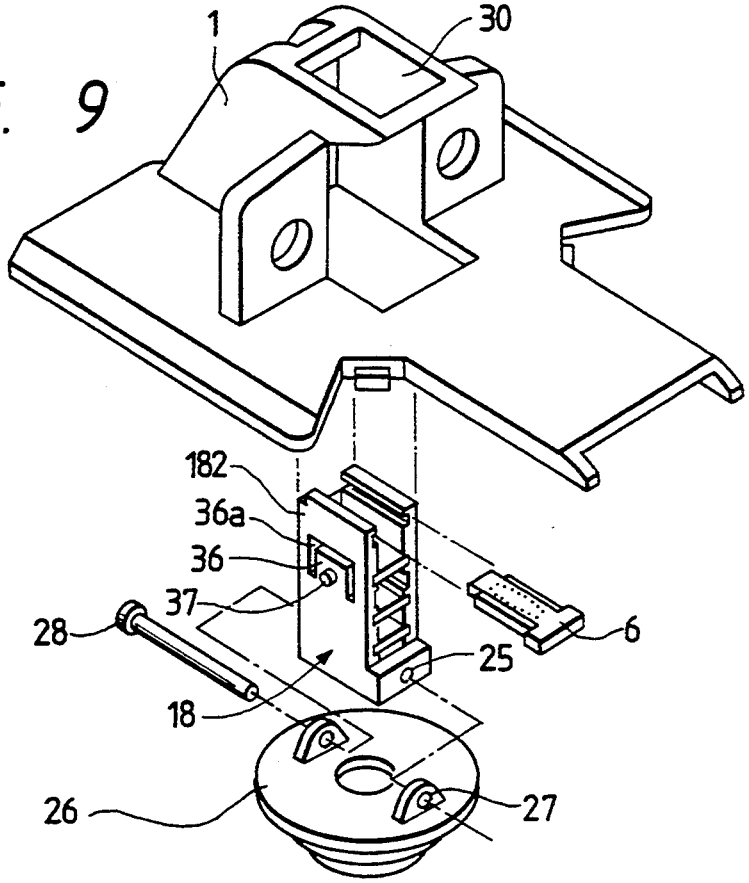
FIG. 9 is an exploded perspective view showing a modified example.

FIG. 9 shows still another modified example, in which tongue-like spring portions 36 are arranged on the side plates 182, 182 of the nose guide 18. Each tongue-like spring portion 36 is formed by making an inverted square "C"-shaped slit 36*a* on the corresponding side plate 182. The tongue-like-spring portion 36 has a projecting portion 37 formed integrally therewith. The tip of each projecting portion 37 is designed to abut against the inner surface of the nose 1.

According to this modified example, the tongue-like spring portions 36 are formed integrally with the nose guide 18, so that the dimensional control of the parts can be facilitated. Further, since the projecting portion 37 of each tongue-like spring portion 36 is abutted against the inner wall of the nose 1, the tongue-like spring portion 36 does not project from the nose guide 18. Therefore, this structure is advantageous in not deforming the springs during the handling of parts unlike in the case where the plate springs are used.

Figure 10:
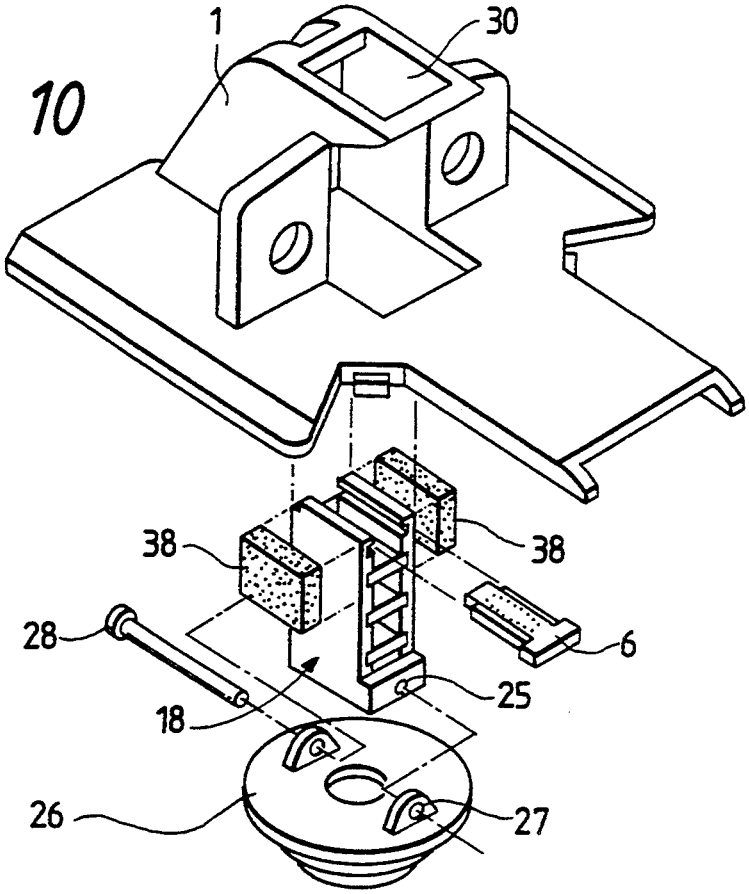
FIG. 10 is an exploded perspective view showing a modified example.

FIG. 10 shows still another modified example, in which sponges 38 are arranged to close the gaps S (see FIG. 2) in the window portion 30 at the front end of the nose 1. Each of the sponges is made of a resilient material and interposed in the gap between the nose guide 18 and the nose 1. This modified example utilizes a resilient force of the sponge 38 as a spring and is designed so as not to impede the movement of the nose guide 18 by the entrance of ribbon dust and paper powder into the gap S between the nose 1 and the nose guide 18.

Figure 11:
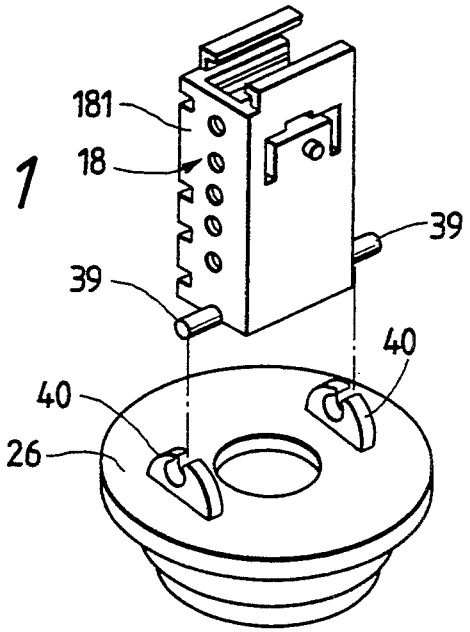
FIG. 11 is an exploded perspective view showing a modified example.
Figure 12:
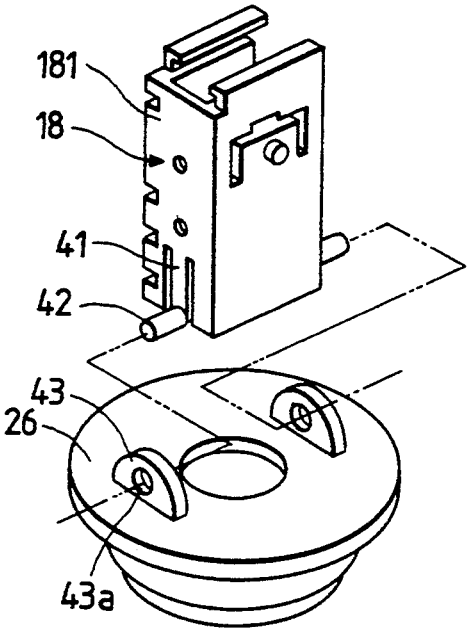
FIG. 12 is an exploded perspective view showing a modified example.
Figure 13:
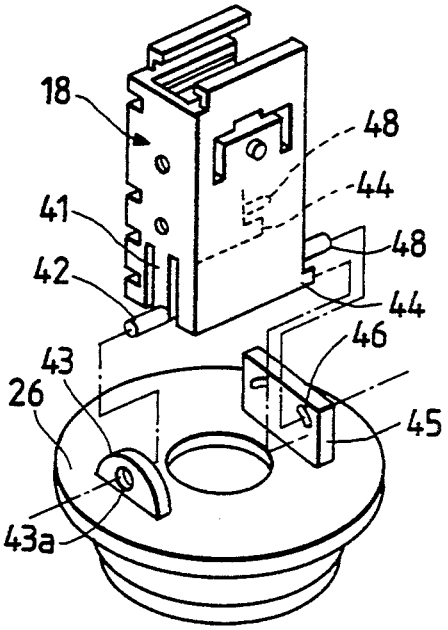
FIG. 13 is an exploded perspective view showing a modified example.

FIGS. 11, 12 and 13 show still other modified examples of the fulcrum of oscillation of the nose guide 18. In either modified example, a shaft portion arranged on the nose guide 18 and a bearing portion arranged on the nose guide base 26 are fitted with each other.

The modified example shown in FIG. 11 is provided as inserting shaft portions 39 arranged at upper and lower positions on the central axis of the nose guide 18 into C-shaped bearing portions 40 arranged at two positions on the central axis of the nose guide base 26. Thus, the shaft portions 39 are inserted by resiliently deforming the bearing portions 40. This structure dispenses with the pin-like shaft 28, thereby contributing to a cost reduction.

The modified example shown in FIG. 12 is provided as forming resilient strips 41 at two positions, upper and lower, on the central axis of the nose guide 18 and arranging shaft portions 42 at the front ends of the respective resilient strips 41. Bearing portions 43 are arranged at two positions, upper and lower, on the central axis of the nose guide base 26, each bearing portion 43 having a hole 43*a*. The shaft portions 42 are inserted into the holes 43*a* of the bearing portions 43 by flexing the resilient strips 41 of the nose guide 18. This structure also dispenses with the pin-like shaft 28, thereby contributing to a cost reduction.

Figure 14:
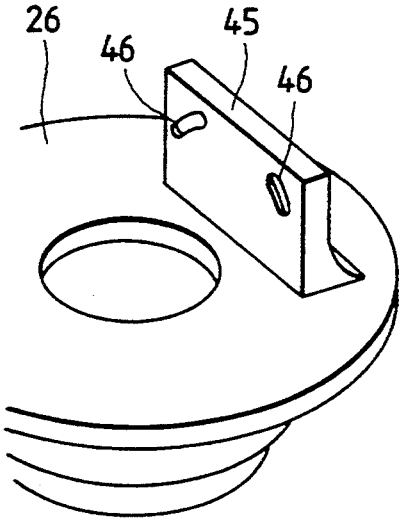
FIG. 14 is a partially enlarged view of FIG. 13.
Figure 15:
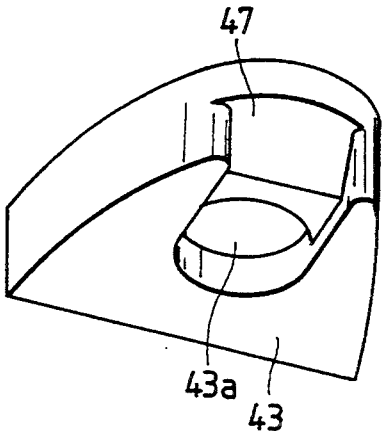
FIG. 15 is a partially enlarged view of FIG. 13 as viewed from a different angle.

The modified example shown in FIG. 13 is provided as forming the resilient strip 41 at the upper position on the central axis of the nose guide 18 and arranging the shaft portion 42 at the front end of the resilient strip 41. On the other hand, the bearing portion 43 that has the hole 43*a* is arranged on the upper position on the central axis of the nose guide base 26, so that the fulcrum of oscillation is formed by inserting the shaft portion 42 into the hole of the bearing portion 43 while flexing the resilient strip 41 of the nose guide 18. Further, on the lower portion of the nose guide 18 are a pair of leg portions 44, and the lower ends of the leg portions 44 are designed to abut against a leg receiving plate 45 arranged at the lower portion of the nose guide base 26. The leg portions 44 not only support the nose guide 18 upward so that the shaft portion 42 from coming out of the bearing portion 43 can be prevented, but also can slide over the leg receiving plate 45 so that the nose guide 18 can oscillate around the shaft portion 42. FIG. 14 shows a detailed diagram of the leg receiving plate 45. As shown in FIG. 14, the leg receiving plate 45 has arcuate grooves 46 with the fulcrum of oscillation as the center. On the other hand, as shown in FIG. 13, the nose guide 18 has pins 48 corresponding to the grooves 46. Since the pins 48 are designed to be guided by the grooves 46 in this structure, the leg portions 44 of the nose guide 18 can be oscillated more stably than in the structure involving no pins 48 and no grooves 46. FIG. 15 is a detailed diagram of the bearing portion 43 of FIG. 13. As shown in FIG. 15, the bearing portion 43 has a guide groove 47 that communicates with the hole 43*a* thereof.

The dimension of the leg receiving plate 45 projecting from the nose guide base 26 is set to a value larger than the dimension of the bearing portion 43 projecting from the nose guide base 26.

In order to assemble the nose guide 18 and the nose guide base 26 in this structure, the leg portions 44 of the nose guide 18 are placed on the leg receiving portion 45 while inserting the pins 48 into the grooves 46. Then, the shaft portion 42 is inserted into the guide groove 47. The shaft portion 42 is inserted into the hole 43*a* of the bearing portion 43 while being flexed along the inclined surface of the guide groove 47, which facilitates the assembling work.

The cases where the shaft portions arranged on the nose guide 18 and the bearing portions arranged on the nose guide base 26 are fitted with each other have been indicated in the examples shown in FIGS. 11, 12 and 13. In contrast with these structures, such a structure that the bearing members arranged on the nose guide 18 and the shaft portions arranged on the nose guide base 26 are fitted with each other may also be applied.

Figure 16:
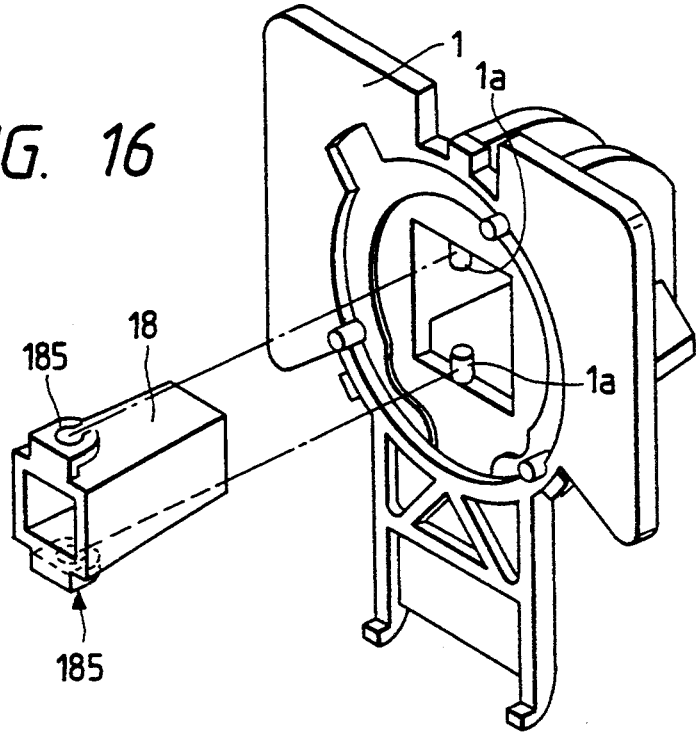
FIG. 16 is an exploded perspective view showing a modified example.

As still another modified example, an oscillatable supporting structure, in which the nose guide base 26 is not employed, is shown in FIG. 16. As shown in FIG. 16, shafts 1*a* are arranged on both upper and lower positions of an opening for inserting the nose guide 18 into the nose 1, and the fulcrum of oscillation may be arranged by fitting the shafts 1*a* with C-shaped bearing portions 185 arranged on the nose guide 18.

Second Embodiment

Figure 17:
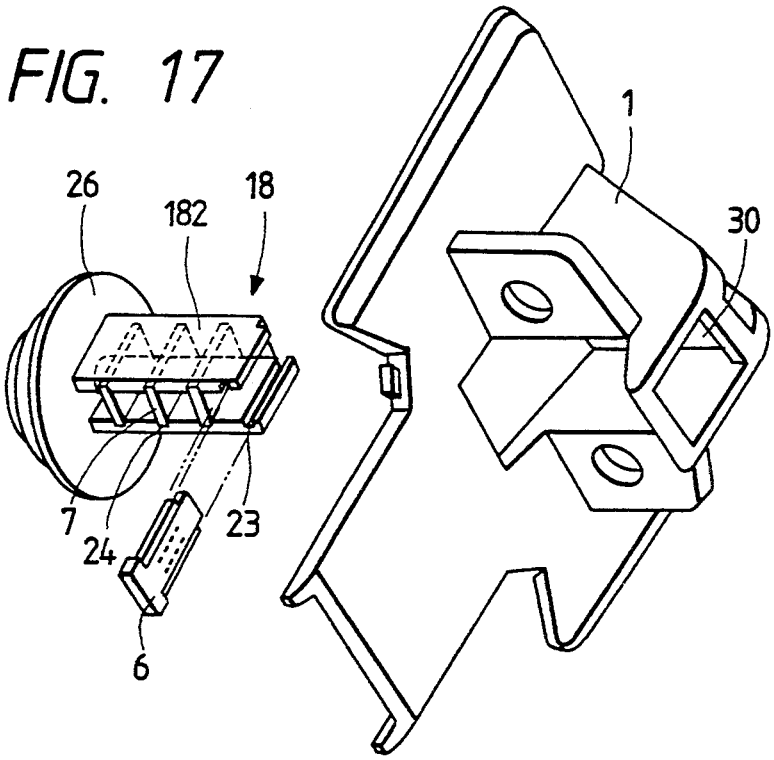
FIG. 17 is an exploded perspective view showing the main portion of an impact dot head, which is a second embodiment of the invention.

FIG. 17 is a perspective view showing the main portion of an impact dot head, which is a second embodiment of the invention.

This embodiment is provided as forming the nose guide 18 of a pair of side plates 182, the front end guide 6, and the intermediate guides 7. The side plates 182 are formed integrally with the nose guide base 26 so as to be flexible in the printing digit direction, and the front end guide 6 is a guide member for oscillatably supporting the wire. More specifically, this embodiment is provided as arranging the side plates 182 formed integrally with the nose guide base 26 so that the side plates 182 can oscillate resiliently by their own resiliency while removing the top plate 181 from the nose guide 18 in the first embodiment. Other aspects are the same as those of the first embodiment.

Figure 18:
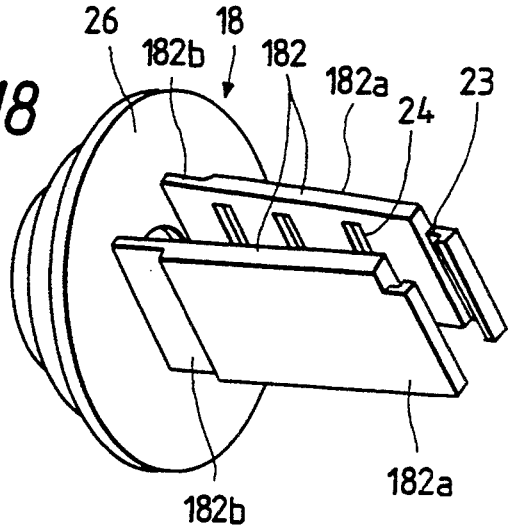
FIG. 18 is an exploded perspective view showing the main portion of a modified example.

Each side plate 182 of the nose guide 18 is not required to be uniformly thick as shown in FIG. 17, but may be partially thin as shown in FIG. 18. That is, the positional relationship between the intermediate guides 7 and the front end guide 6 may be ensured by holding the front end guide 6 with thick portions 182*a* of the side plates, and the front end guide 6 and the intermediate guides 7 may be oscillatably supported by utilizing resiliency of thin portions 182*b* of the side plates. The thickness of each thin portion 182*b* may be set so that an appropriate spring force can be obtained.

The same operation as in the first embodiment can be performed in this embodiment. That is, since the nose guide 18 is oscillatable in the printing digit direction, wire breakage to be caused at the time the head passes the end of the printing sheet can be prevented. Further, once the head has passed the end of the printing sheet, resiliency of the side plates 182 causes the nose guide 18 to return to the middle position, thereby maintaining high-quality printing.

Still further, since the nose guide 18 is oscillatable by its own resiliency, no additional component for oscillation is required to achieve the object of the invention in this embodiment unlike in the case of the first embodiment.

Third Embodiment

Figure 19:
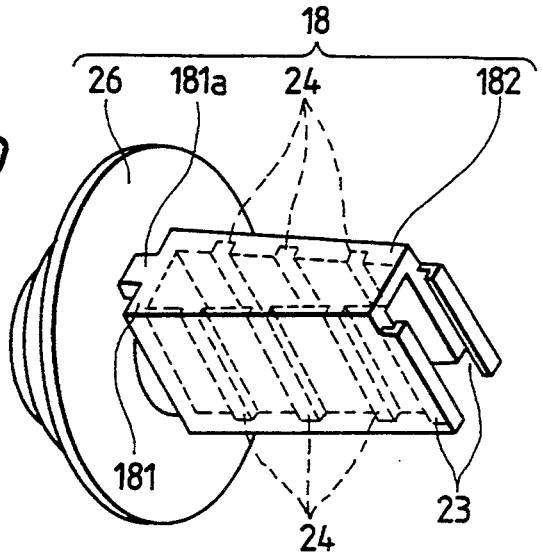
FIG. 19 is an exploded perspective view showing the main portion of an impact dot head, which is a third embodiment of the invention.

FIG. 19 shows a perspective view showing the main portion of an impact dot head, which is a third embodiment of the invention.

The feature of this embodiment over the first embodiment is that the nose guide 18 is arranged so as to be oscillatable in the printing digit direction by partially integrally coupling only the top plate 181 of the nose guide 18 to the nose guide base 26. The portion through which the top plate 181 of the nose guide 18 is partially coupled to the nose guide base 26 is designated as 181*a*. The coupled portion 181*a* is thin and not rigid, thus being subject to resilient deformation when a bending force is applied thereto. This feature allows the nose guide 18 to be resiliently oscillatable in the printing digit direction. Other aspects are the same as those of the first embodiment.

The same operation as in the first embodiment can be performed in this embodiment. That is, since the nose guide 18 is oscillatable in the printing digit direction, wire breakage to be caused at the time the head passes the end of the printing sheet can be prevented. Further, once the head has passed the end of the printing sheet, resiliency of the side plates 182 causes the nose guide 19 to return to the middle position, thereby maintaining high-quality printing.

Still further, since the nose guide 18 is oscillatable by its own resiliency, no additional component for oscillation is required to achieve the object of the invention in this embodiment unlike in the case of the first embodiment.

While the resiliency is imparted to the nose guide 18 by coupling only the top plate 181 of the nose guide 18 to the nose guide base 26 partially as well as integrally in the third embodiment, the mode of integrally coupling the top plate to the nose guide base 26 may be selectable as long as the resiliency can be imparted to the nose guide 18. With respect to this point, the same applies to the second embodiment.

Therefore, even in the case where the side plates and the top plate are formed integrally with the nose guide base by arranging the top plate on the nose guide in the second embodiment, or even in the case where not only the top plate 181 but also the side plates 182 are coupled to the nose guide base 26 in the third embodiment, the object of the invention can be achieved, as long as, e.g., the coupling portion of the nose guide base 26 and the nose guide 18 is made partially thin and less rigid or as long as the entire part of the nose guide 18 is made of a material liable to resilient deformation such as rubber.

Fourth Embodiment

Figure 20:
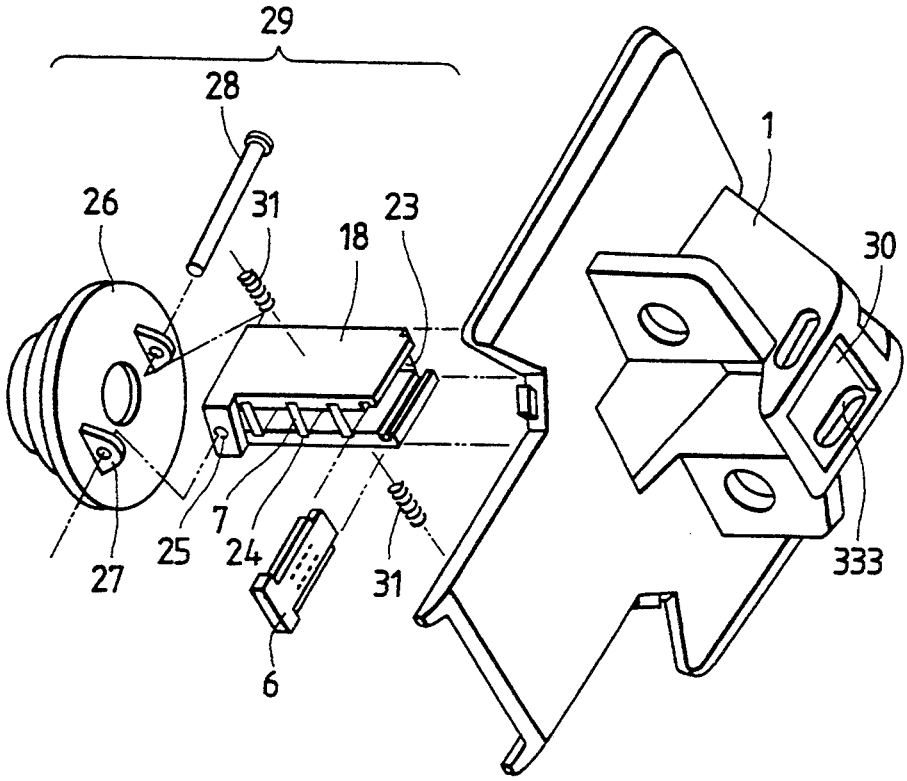
FIG. 20 is an exploded perspective view showing the main portion of an impact dot head, which is a fourth embodiment of the invention.

FIG. 20 is a perspective view showing the main portion of an impact dot head, which is a fourth embodiment of the invention.

This embodiment is applicable to a head of such a type that the nose guide 18 oscillates, i.e., to any one of the first, second and third embodiments, and is provided as arranging openings 333 on both side surfaces of the front end of the nose 1.

When the impact dot heads described above have been used over a long period of time, paper powder derived from the printing sheet 19 and debris derived from the ink ribbon 21 clog the window portion 30 of the nose 1. Such clogging may, in some cases, hampers the oscillation of the nose guide 18 when the head passes the end of the printing sheet 19.

This embodiment is provided as arranging the openings 333 for preventing such a trouble.

Figure 21:
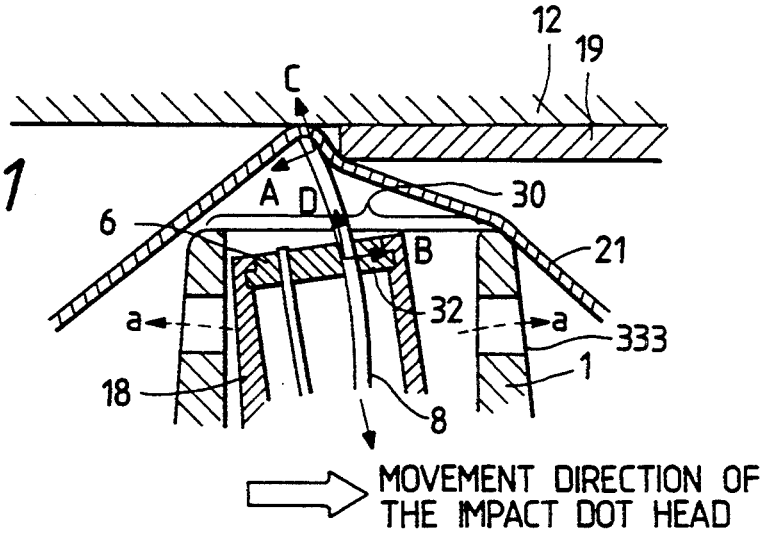
FIG. 21 is a diagram illustrative of the operation of the fourth embodiment.

According to this arrangement, the paper powder and the debris of the ribbon that have entered into the window portion 30 of the nose 1 are discharged from the openings 333 as shown by a broken arrow "a" in FIG. 21, thereby preventing the nose guide 18 from being unable to oscillate. The impact dot head moves in the direction of arrow Z.

Figure 22:
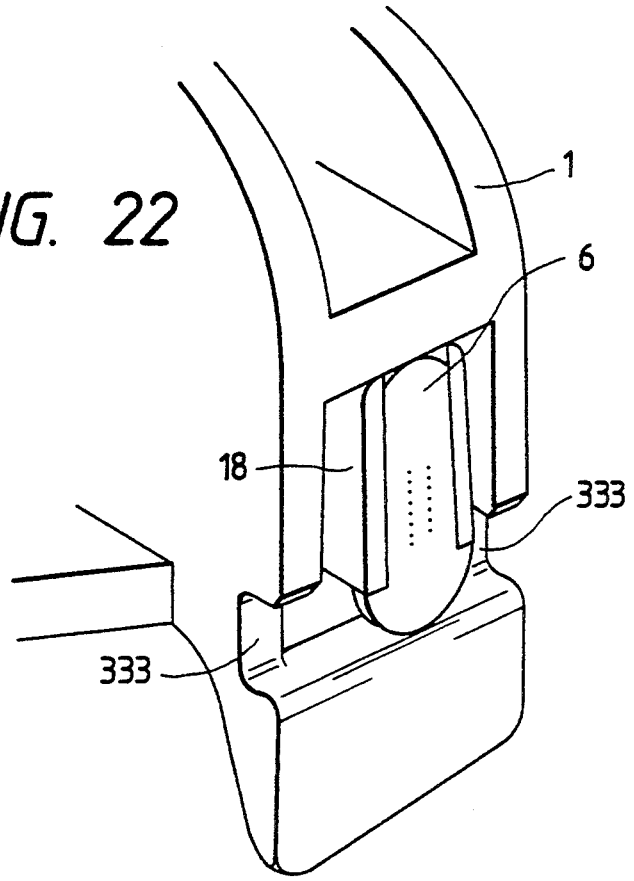
FIG. 22 is a perspective view showing the main portion of a modified example.

The openings 333 may take any shape. For example, groove-like openings such as shown in FIG. 22 may allow the same operation to be performed.

Fifth Embodiment

Figure 23:
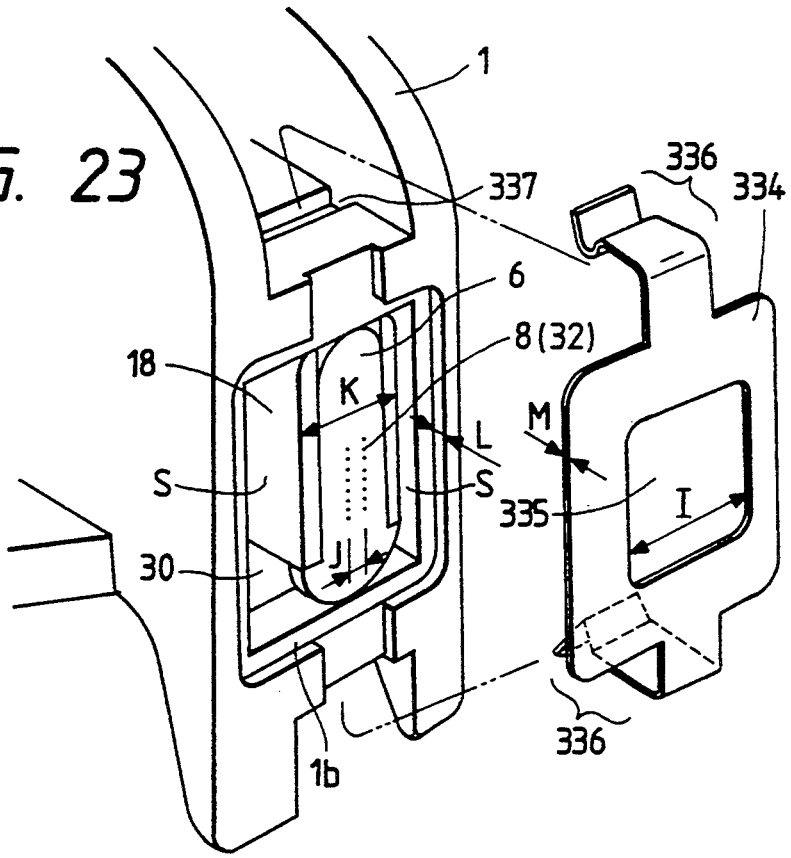
FIG. 23 is an exploded perspective view showing the main portion of an impact dot head, which is a fifth embodiment of the invention.

FIG. 23 is a perspective view showing the main portion of an impact dot head, which is a fifth embodiment of the invention.

Like the above-described fourth embodiment, this embodiment is designed to prevent the nose guide 18 from being unable to oscillate. Therefore, this embodiment can also be applied to the head of such type that the nose guide 18 is oscillatable, i.e., to any one of the first, second and third embodiments.

The fifth embodiment is provided as arranging a thin plate 334 on a front end portion of the nose guide 18, the thin plate being designed to close gaps S formed between the front end portion of the nose guide 18 and the nose 1.

The thin plate 334 has an opening 335. The opening 335 is formed to be wider than an area in which a guide hole 32 of the front end guide 6 is arranged. Specifically, the width I of the opening 335 is smaller than the width K of the nose guide 18, and is larger than the length obtained by adding the angular displacement of the nose guide 18 to the distance J between the wire arrays 8. That is, the width I is so set that the thin plate 334 closes the gaps S of the window portion 30, and that the wire 8 does not abut against the edge of the opening 335 even if the nose guide 18 does make an angular displacement. A step L that is deeper than the thickness M of the plate 334 is arranged around the window portion 30 on a surface 1*b* against which the thin plate 334 of the nose 1 abuts, so that the thin plate 334 does not project from the front end surface of the nose 1. Such consideration is given to prevent abnormal travel of the ink ribbon due to the ink ribbon being caught by the edge of the thin plate 334.

The thin plate 334 has resilient arms 336 and is mounted on the front side of the nose 1 by fitting the resilient arms 336 into recessed portions 337 arranged on both upper and lower portions of the nose 1.

According to this arrangement, the thin plate 334 checks the ingress of the paper powder and the debris of the ribbon into the gaps S, thereby preventing the nose guide 18 from being unoscillatable.

The thin plate 334 may preferably be made of a rigid material, such as a stainless steel or a blue ribbon steel.

Figure 24:
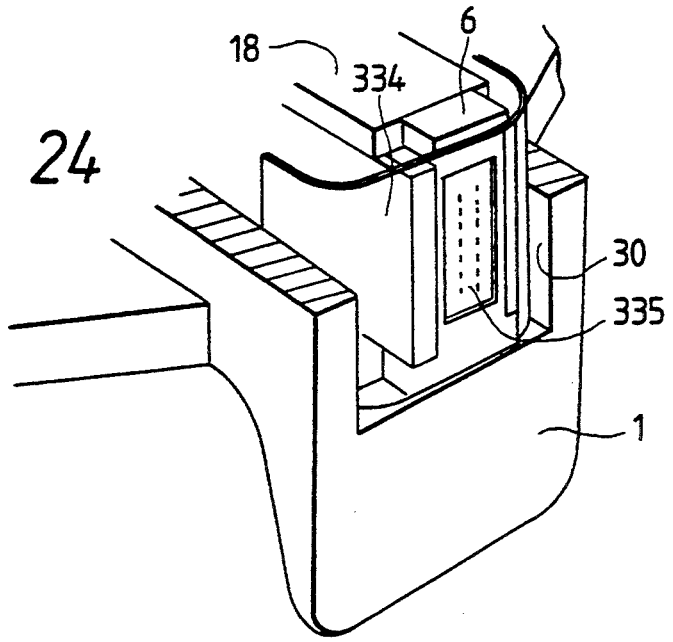
FIG. 24 is a perspective view showing the main portion of a modified example.

FIG. 24 shows a modified example of the thin plate 334 and of a mounting structure therefor. In this modified example, the thin plate 334 is bonded to the front end guide 6, so that the gaps S in the window portion 30 are closed by the thin plate 334 being flexed when the nose guide 18 is inserted into the nose 1. The thin plate 334 and the nose guide 18 are bonded around the opening 335. The thin plate 334 in this modified example may preferably be made of a plastic sheet in polyester or the like. The thin plate 334 may be bonded to the nose guide 18 by an adhesive, an adhesive double coated tape, or by heat welding.

Such modified example allows the thin plate 334 to prevent ingress of the paper powder and the debris of the ribbon. As to the oscillation of the nose guide, the thin plate 334 is not a hindrance because the rigidity of the thin plate 334 is sufficiently low.

The opening 335 in the above-described embodiment may be oval or polygonal having four sides or more, not limited to being tetragonal.

Sixth Embodiment

Figure 25:
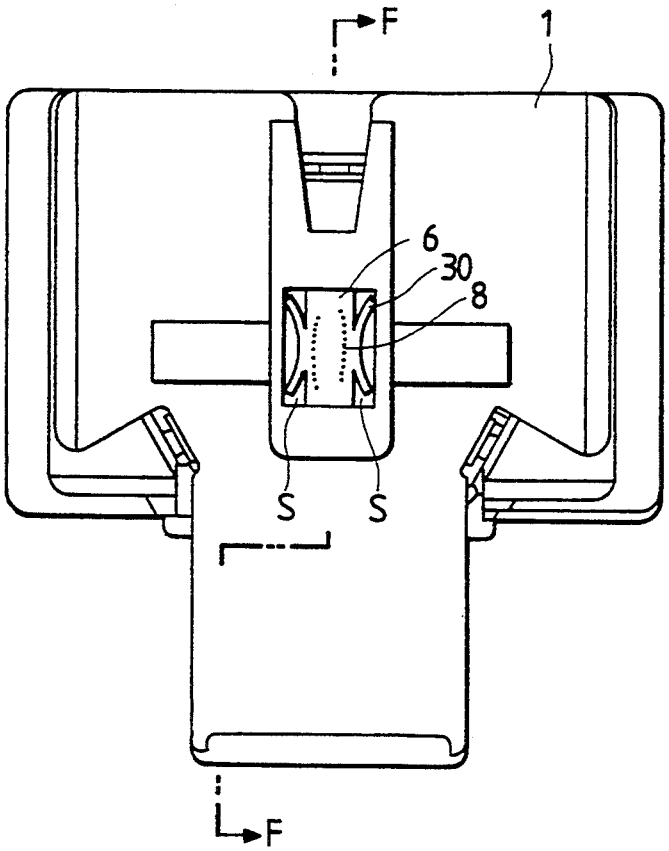
FIG. 25 is a front view showing an impact dot head, which is a sixth embodiment of the invention.
Figure 26:
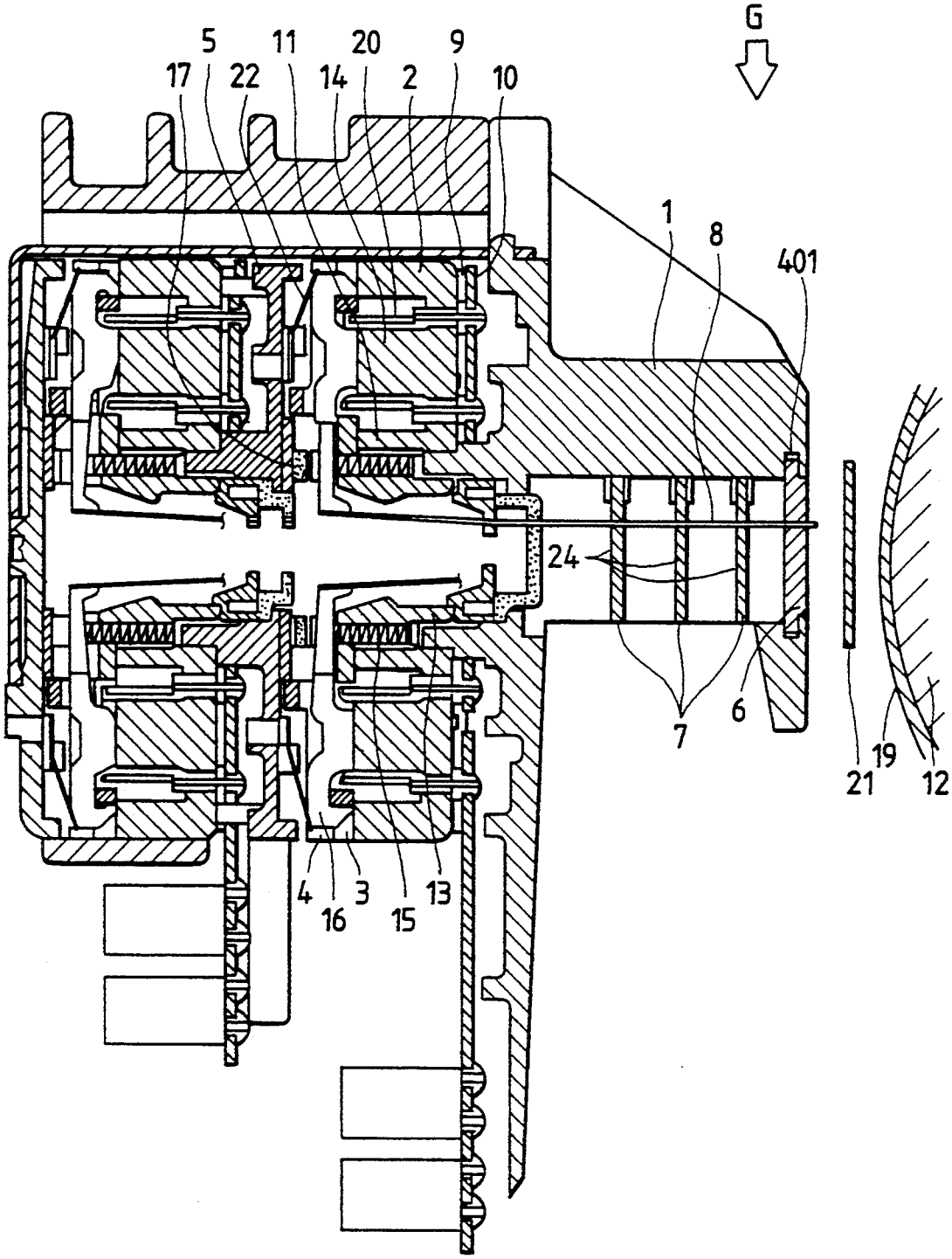
FIG. 26 is a sectional view taken along a line 26—26 FIG. 25.

FIG. 25 is a front view showing an impact dot head, which is a sixth embodiment of the invention; FIG. 26 is a sectional view taken along a line F—F of FIG. 25; and FIG. 27 is an exploded perspective view showing the main portion of this embodiment.

The feature of the sixth embodiment over the first embodiment is that it is the front guide 6 that is supported by the nose 1 so as to be oscillatable in the printing digit direction, in contrast to the first embodiment in which it is the nose guide 18 that is supported so as to be oscillatable.

Figure 27:
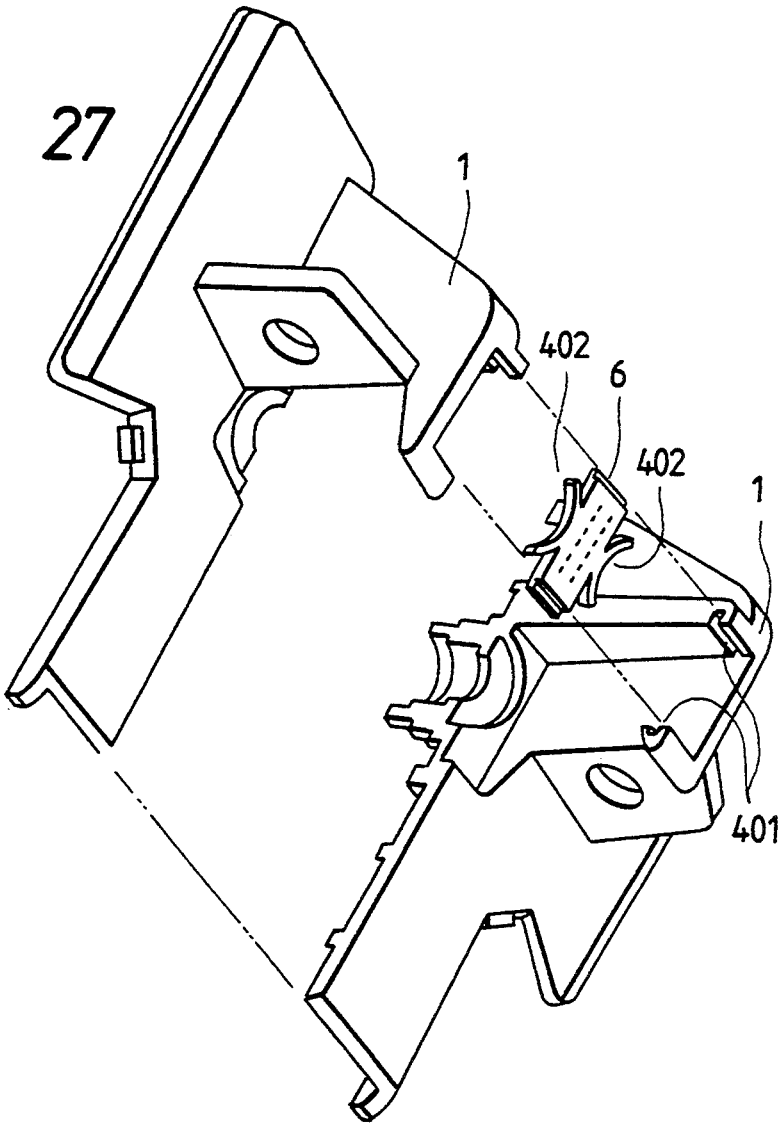
FIG. 27 is an exploded perspective view showing the main portion.

As shown in FIG. 27, the nose 1 is divided into two pieces, right and left. Guide grooves 401 for slidably guiding the front end guide 6 are arranged on the respective nose pieces 1. The width of each guide groove 401 is set to a value slightly larger than the thickness of the front end guide 6, so that the front end guide 6 can slide along the guide grooves 401. The nose 1 and the front end guide 6 can be assembled first by inserting the front end guide 6 into the guide grooves 401 of one of the nose piece 1, and then by coupling the other nose piece thereto. According to this structure, the front end guide 6 can be slidably supported by assembling the nose formed of two pieces. Therefore, it is not likely that the front end guide 6 will come out of the nose 1. In terms of fabricating the nose 1, the structure that the nose 1 is formed of two pieces is advantageous in facilitating the guide grooves 401 to be formed.

While the front end guide 6 is guided into the guide grooves 401 of the nose 1, the guide grooves 401 only slidably guide the upper and lower ends of the front end guide 6; the front end guide 6 has gaps S on the left and right ends thereof in the window portion 30 of the nose 1 (see FIG. 25). The front end guide 6 has a biasing means for biasing the front end guide 6 so that the front end guide 6 is positioned in the middle of the nose 1. The biasing means of this embodiment is implemented by arcuate resilient arms 402 that are integrally formed on both left and right of the front end guide 6.

As shown in FIG. 26, the intermediate guides 7 are held by the intermediate guide grooves 24 arranged on the inner surface of the nose 1.

According to the thus arranged impact dot head, it is the front end guide 6 that slides in the printing digit direction, instead of the nose guide 18 oscillating in the printing digit direction in the head of the first embodiment. As a result, the same operation and advantage as in the first embodiment can be performed and obtained.

Figure 28:
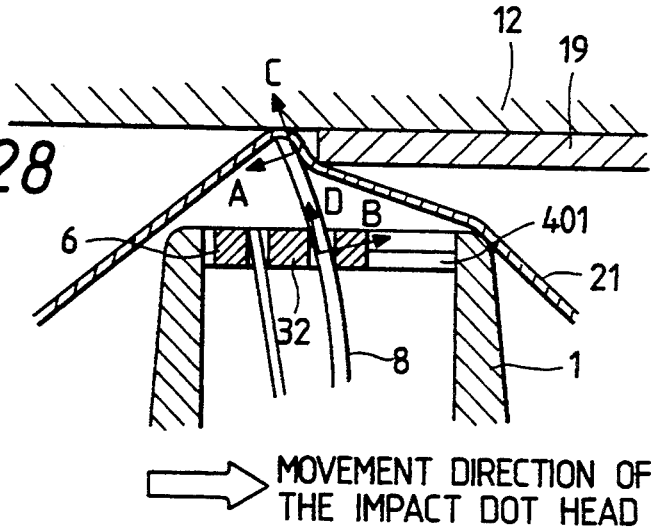
FIG. 28 is a diagram illustrative of the operation of the sixth embodiment.

That is, as shown in FIG. 28, the impact dot head moves in the direction of arrow Z. As the impact dot head passes the end of the printing sheet 19, the front end guide 6 slides along the guide grooves 401 while deforming the resilient arms 402, omitted in FIG. 28, resiliently. As a result, the frictional forces C and D that impede the return operation of the wire 8 are decreased, thereby preventing the wire from being broken. Further, once the head has passed the end of the printing sheet 19, the front end guide 6 returns to the middle of the window portion 30 of the nose 1 by the resilient force of the resilient arms 402, thereby maintaining high-quality printing.

Figure 29:
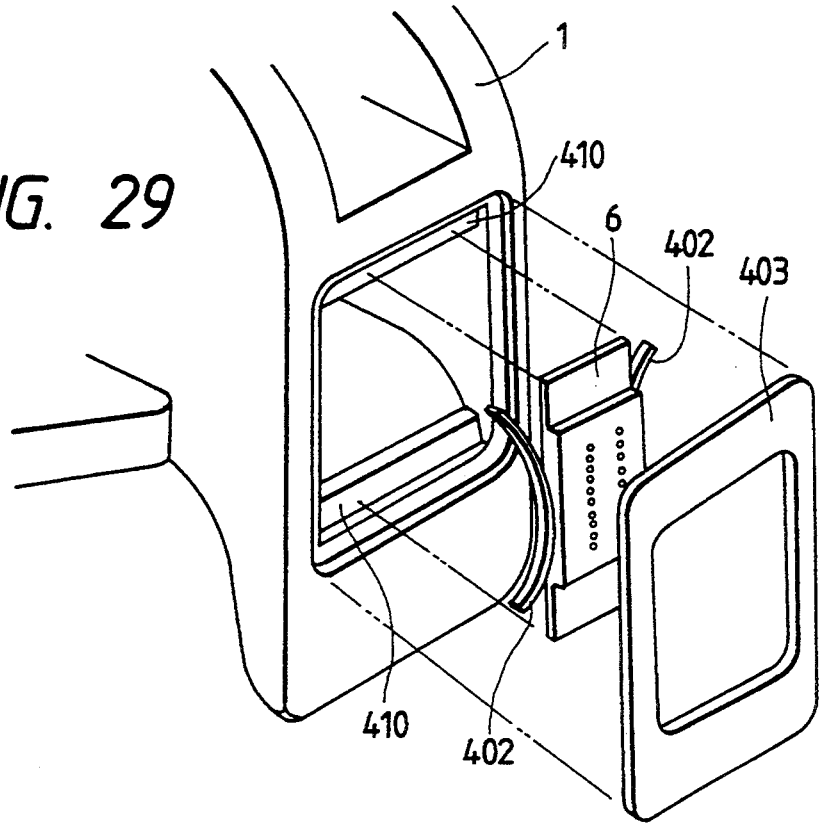
FIG. 29 is an exploded perspective view showing a modified example.

FIG. 29 shows a modified example in which a guide frame 403 made of a thin plate is involved. In this example, the guide grooves 401 for slidably supporting the front end guide 6 are formed by coupling the front end of the nose 1 to the guide frame 403. The front end guide 6 is slidably supported by placing the front end guide 6 on a guide receiving surface 410 of the nose 1 and securing to each other while covering the guide frame 403 over the front end of the nose 1.

According to this structure, the guide frame 403 can be made of a material different from that of the nose 1. If the guide frame 403 is formed of a wear-resistant material such as metals or ceramics, then the falling off of the front end guide 6 due to wear of the guide frame 403 by friction with the ink ribbon can be prevented.

Figure 30:
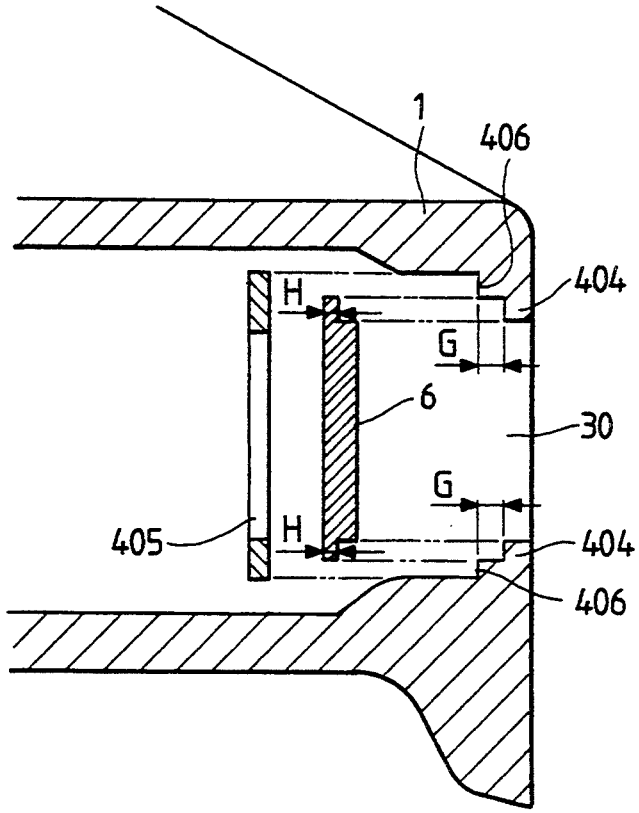
FIG. 30 is a sectional view showing a modified example.

FIG. 30 shows another modified example, in which ribs 404 are arranged on both upper and lower portions of the window portion 30 of the nose 1 and the front end guide 6 is slidably mounted from the inner side of the nose 1. Usually, an impact dot head is assembled by stacking the parts while placing the nose 1 in a direction so that the front end side of the wire 8 (the right side as viewed in FIG. 30) faces downward. Since the front end guide 6 is mounted from the inside of the nose 1 in this modified example, what may be required during assembling is to drop the front end guide 6 into the nose 1. Then, a back surface guide frame 405 is dropped and inserted into the nose 1 by force, so that the front end guide 6 can be held slidably by the ribs 404 of the nose 1 and the back surface guide frame 405. In order that the front end guide 6 is slidable, a stepped portion 406 is arranged on an inner wall of the nose 1. A step G of the stepped portion 406 is slightly larger than the thickness H of the plates on both upper and lower ends of the front end guide 6. The back surface guide frame 405 is mounted while abutted against the stepped portion 406, so that the front end guide 6 is free from being fixed while interposed therebetween.

Figure 31:
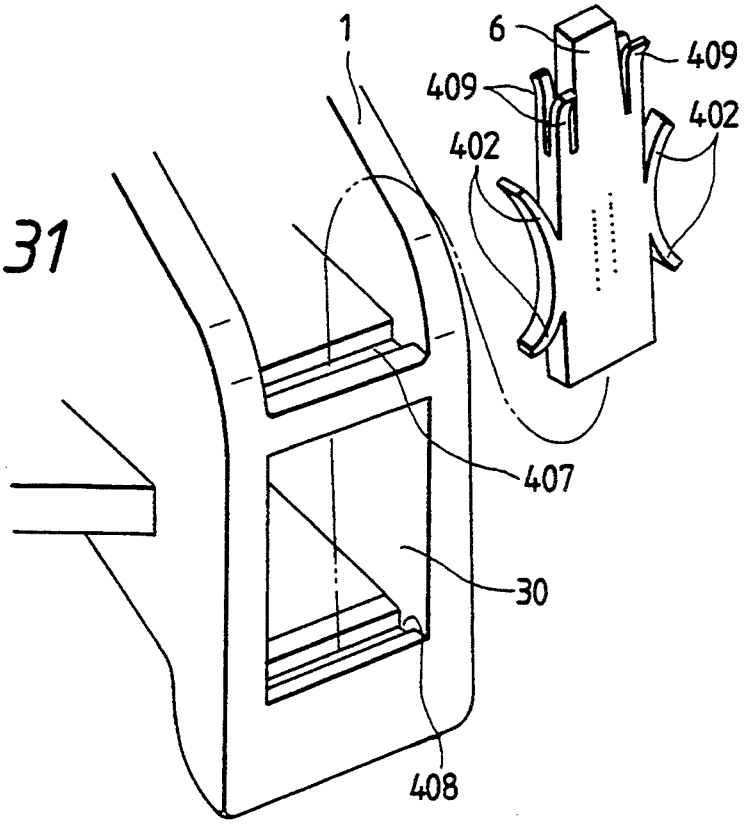
FIG. 31 is an exploded perspective view showing a modified example.

FIG. 31 shows still another modified example, in which a through slit 407 is arranged on the upper surface of a front end portion of the nose 1, and a guide groove 408 whose section is recessed is arranged on a lower portion of the front end of the nose 1. The front end guide 6 has resilient catches 409 that prevent the coming out of the front end guide 6 in addition to the resilient arms 402. The nose guide 6 is assembled by inserting the front end guide 6 into the window portion 30 from the through slit 407. Since the resilient catches 409 have resiliency, the resilient catches 409 retreat as they pass the through slit 407 and expand after having passed the through slit 407 (return to the original condition). This is how the resilient catches 409 operate to prevent the coming out of the front end guide 6. According to this structure, no special parts are required for holding the front end guide 6, thereby providing slidable support of the front end guide 6 with a simple structure.

Figure 32:
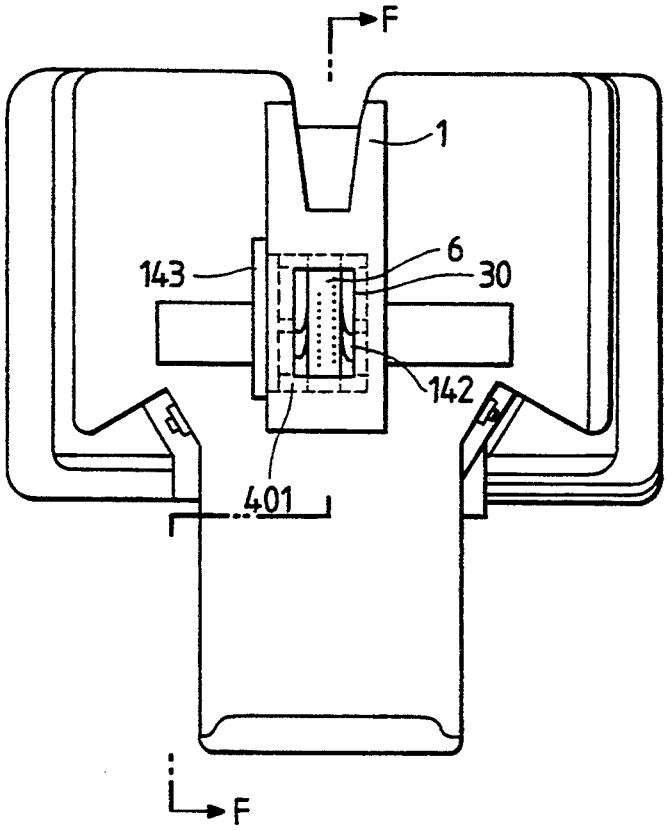
FIG. 32 is a front view showing a modified example.
Figure 33:
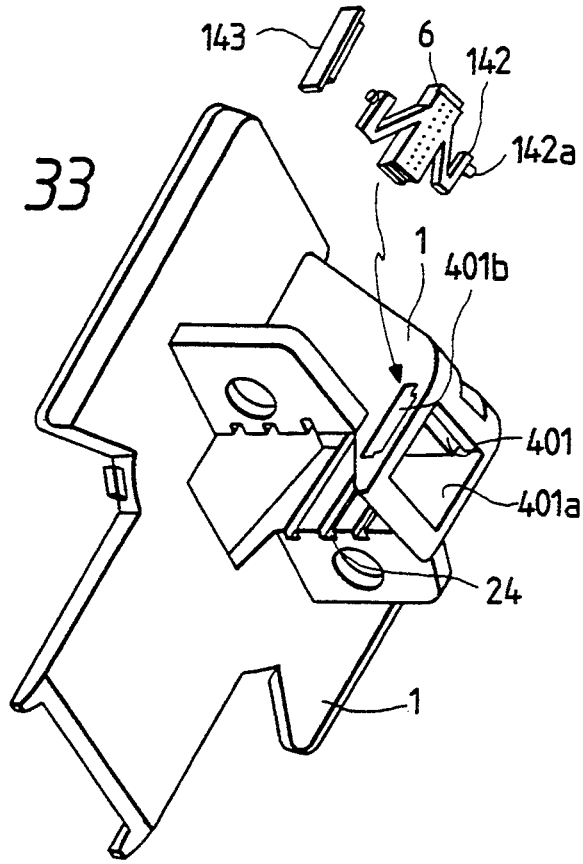
FIG. 33 is an exploded perspective view showing the main portion of the modified example shown in FIG. 32.
Figure 34:
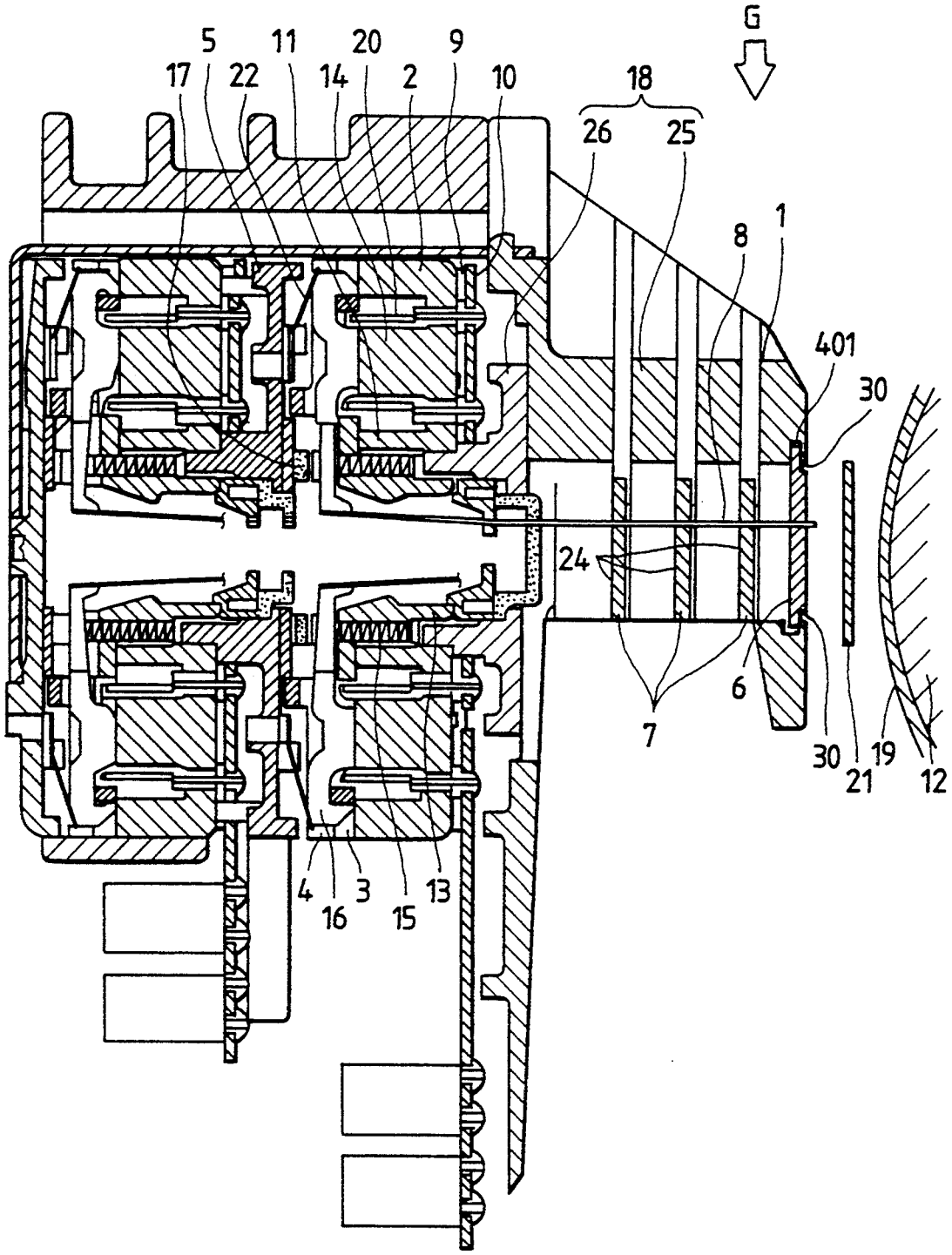
FIG. 34 is a sectional view taken along a line F—F of FIG. 32.

FIGS. 32, 33 and 34 show still another modified example, which is provided as forming one end 401*a* of the guide groove 401 arranged on the nose 1 into a wall and another end 401*b* of the guide groove 401 is opening. FIG. 32 is a front view; FIG. 33 is an exploded perspective view showing the main portion; and FIG. 34 is a sectional view taken along a line F—F of FIG. 32. To assemble the front end guide 6 into the nose 1, the front end guide 6 is first inserted from an opening 401*b*, and the opening 401*b* is then closed by a closing member 143. The closing member 143 is secured to the nose 1. According to this structure, the presence of the opening 401*b* allows the guide groove 401 to be formed easily on the nose 1 without dividing the nose into two pieces. The resilient arms 142 of the front end guide 6 are substantially V-shaped, and a projection 142*a* is arranged on the front end of each resilient arm 142.

Figure 35:
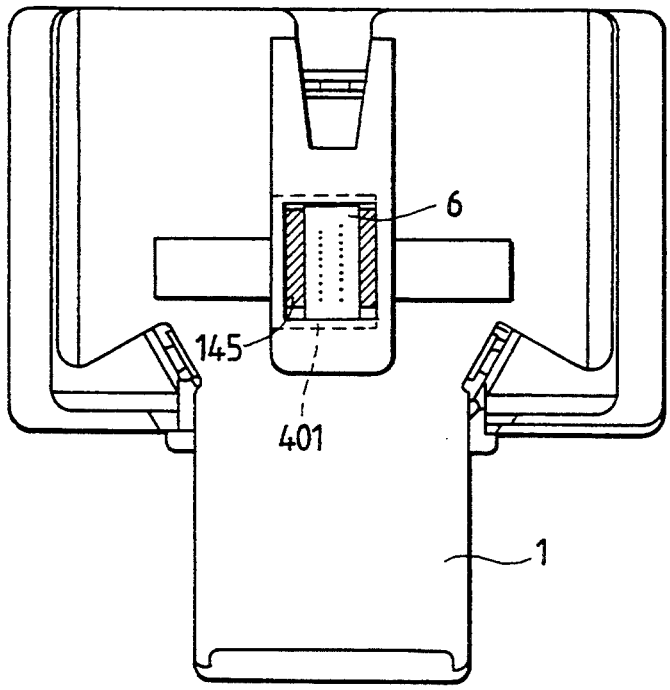
FIG. 35 is a front view showing a modified example.
Figure 36:
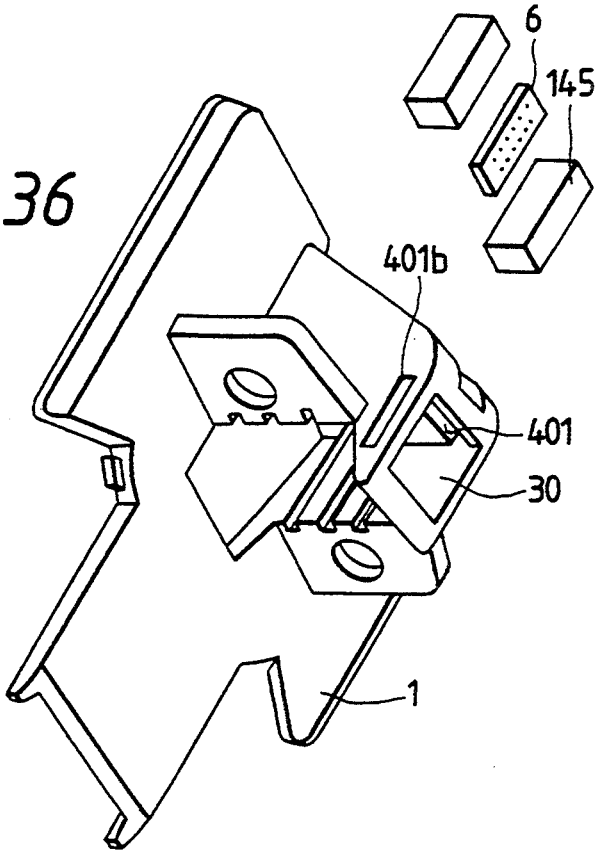
FIG. 36 is an exploded perspective view of the modified example shown in FIG. 35.

FIGS. 35 and 36 show still another modified example, which is provided as using spacers 145 for biasing the front end guide 6 so that the front end guide 6 is positioned in the middle of the nose 1, each spacer being made of a resilient material. FIG. 35 is a front view thereof; and FIG. 36 is an exploded perspective view of the main portion thereof. An end of the guide groove 401 in this example is formed into the opening 401*b*. The spacer 145 is made of rubber or sponge and is larger than the opening 401*b*. To assemble the front end guide 6 into the nose 1, the front end guide 6 is inserted into the guide groove 401 from the opening 401*b*, and then each spacer 145 is fitted between the inner surface of the nose and a side of the front end guide 6. Such arrangement dispenses with the resilient arms on the front end guide 6 and prevents entrance of the paper powder or the like from the window portion 30.

Seventh Embodiment

Figure 37:
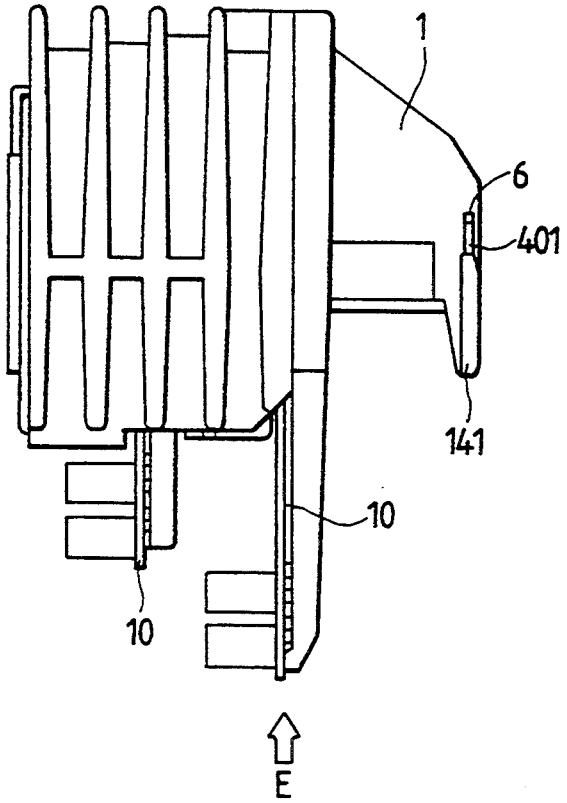
FIG. 37 is a side view showing an impact dot head, which is a seventh embodiment of the invention.
Figure 38:
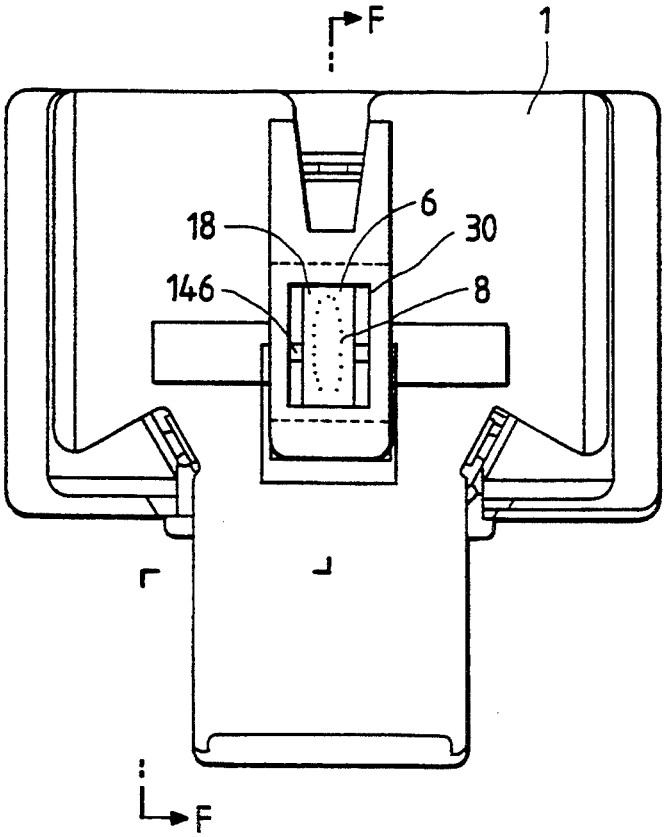
FIG. 38 is a front view thereof.
Figure 39:
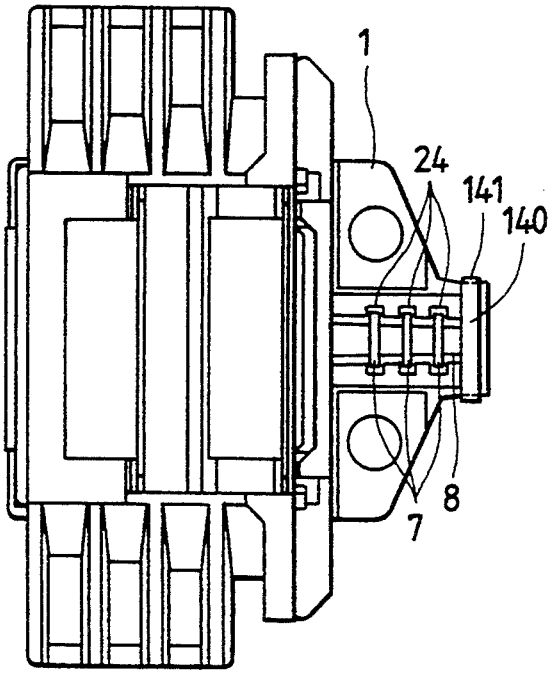
FIG. 39 is a plan view of FIG. 37 as viewed from a position E.
Figure 40:
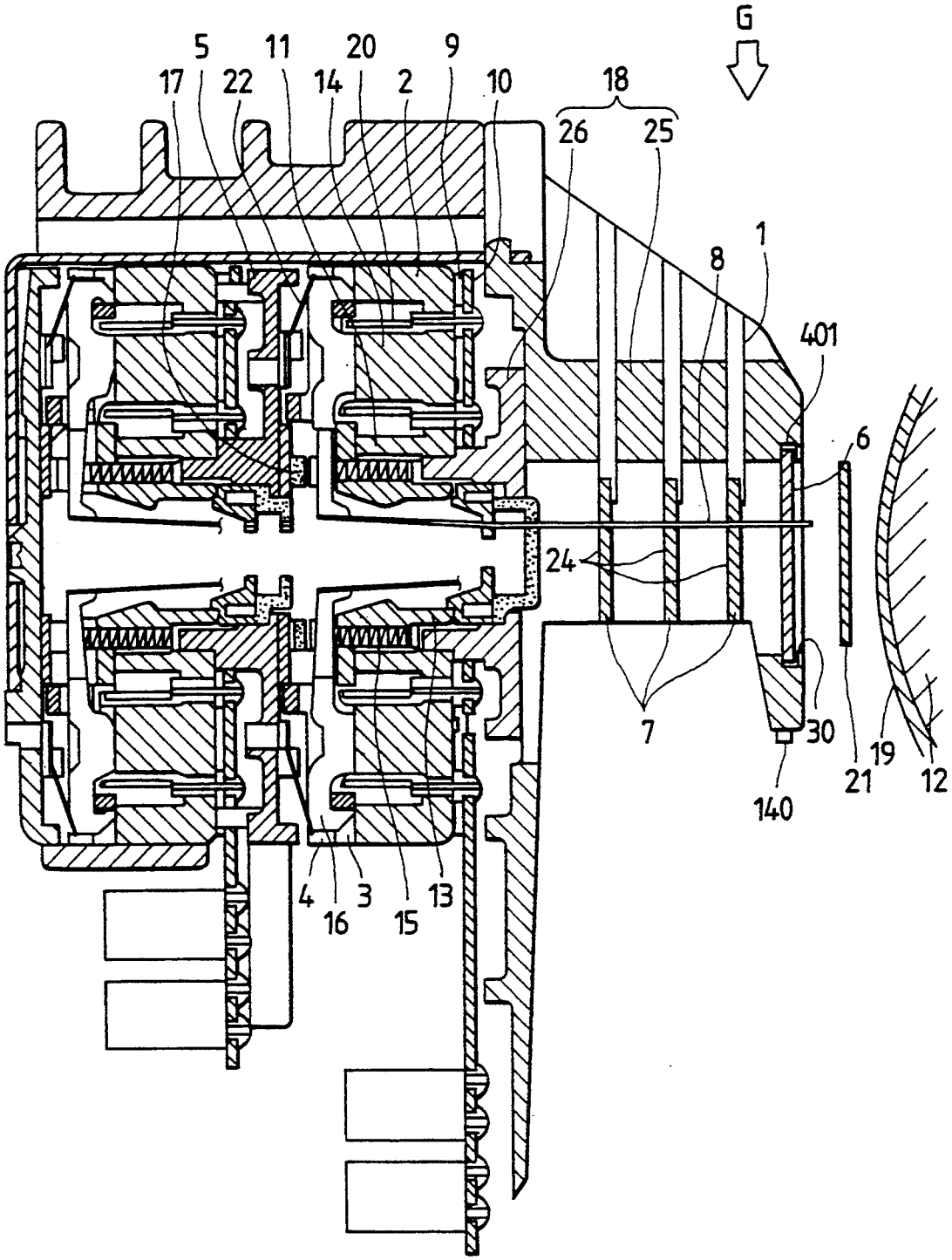
FIG. 40 is a sectional view taken along a line 40—40 of FIG. 38.
Figure 41:
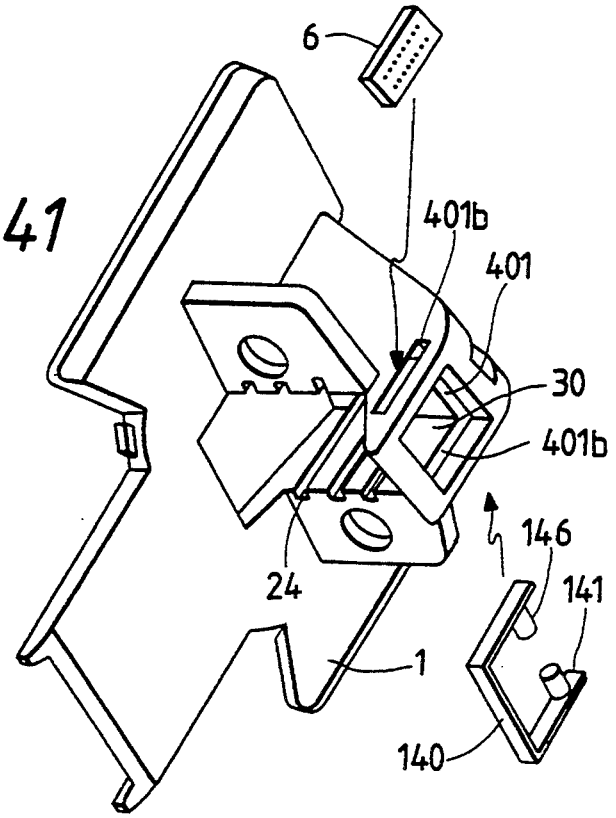
FIG. 41 is an exploded perspective view of the main portion thereof.

FIG. 37 is a side view showing an impact dot head, which is a seventh embodiment of the invention; FIG. 38 is a front view thereof; FIG. 39 is a plan view of FIG. 37 as viewed from a position E; FIG. 40 is a sectional view taken along a line F—F of FIG. 38; and FIG. 41 is an exploded perspective view showing the main portion thereof.

The feature of this embodiment over the sixth embodiment is that the biasing means for biasing the front end guide 6 so that the front end guide 6 can be positioned in the middle of the nose 1 is formed of a front end guide holder 140 which is mounted from the outside of the front end of the nose 1 and which has resiliency.

Both ends of the guide groove 401 arranged on the front end portion of the nose 1 are formed into the openings 401*b*.

The front end guide holder 140 has a pair of resilient arms 141. On the inner side of each resilient arm 141 is a projecting portion 146. The front end guide holder 140 is mounted on the front end of the nose 1 by inserting the projecting portions 146, 146 into the openings 401*b*, 401*b* of the guide groove, and supports the front end guide 6 so as to be positioned in the middle of the window portion 30 by causing the projecting portions 146, 146 to bias the both sides of the front end guide 6 with the resilient force of the resilient arms 141.

To mount the front end guide 6 and the front end guide holder 140 on the nose 1, the front end guide 6 is first inserted into the guide groove 401, and then the front end guide holder 140 is installed from below the front end of the nose while opening the resilient arms 141.

The thus arranged front end guide 6 of the impact dot head is able to be slid to slide in the printing digit direction, so that the same operation and advantage as in the sixth embodiment can be performed and obtained.

Figure 42:
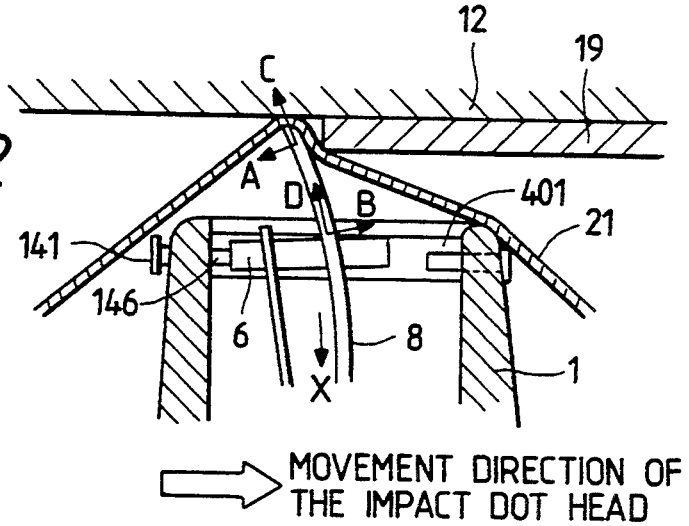
FIG. 42 is a diagram illustrative of the operation of the seventh embodiment.

That is, as shown in FIG. 42, the impact dot head moves in the direction of arrow Z. When the impact dot head passes the end of the printing sheet 19, the front end guide 6 slides along the guide groove 401 while resiliently deforming the resilient arms 141 of the front end guide holder 140. As a result, the frictional forces C and D that hinder the returning of the wire 8 can be decreased, thereby obviating wire breakage. Further, once the impact dot head has passed the end of the printing sheet 19, the front end guide 6 returns to the middle of the window portion 30 of the nose 1, thereby maintaining high-quality printing.

Still further, this embodiment is provided as installing the front end guide holder 140 from the outside of the nose 1, which provides the advantage of facilitating the assembling and disassembling of the front end guide holder 140. For example, if the end of a printing sheet is printed frequently, then it can happen that a spring resiliently holding the front end guide 6 is subjected to deterioration and, as a result, that the normal printing quality can no longer be ensured. In this case, the front end guide holder 140 can be replaced without involving special tools, thus allowing the front end guide 6 to be resiliently held again. Therefore, the impact dot head can be repaired extremely easily, achieving that the replacing operation can be handled by the user.

Figure 43A:
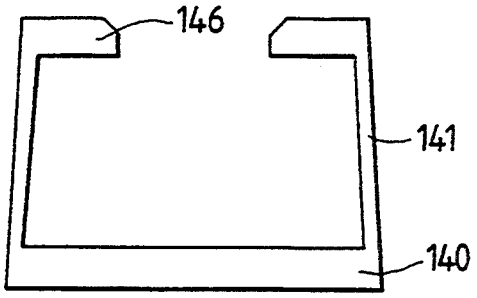
FIGS. 43 (*a*), (*b*) and (*c*) are front views showing modified examples of a holder.
Figure 43B:
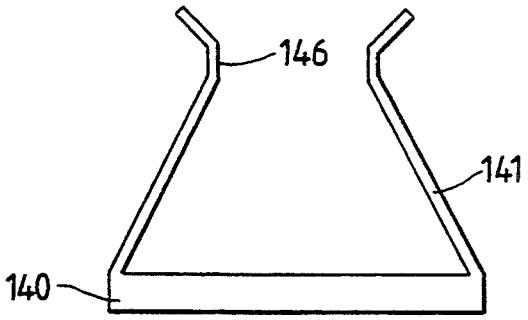
Figure 43C:
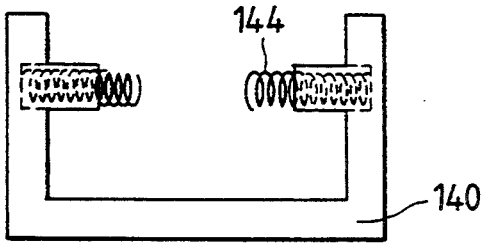

The shape of the front end guide holder 140 is not limited to the above-described one, but may be such as shown in FIGS. 43 (*a*) and (*b*) as long as the front end guide 6 can be held in the middle of the window portion of the nose 1 resiliently. FIG. 43 (*a*) shows projecting portions 146 that are formed integrally with the front ends of the resilient arms 141, whereas FIG. 43 (*b*) shows projecting portions 146 being formed by bending the resilient arms 141.

Further, as shown in FIG. 43 (*c*), coil springs 144 may be arranged in place of the projecting portions 146, so that the coil springs 144 can hold the front end guide 6 resiliently.

Figure 44:
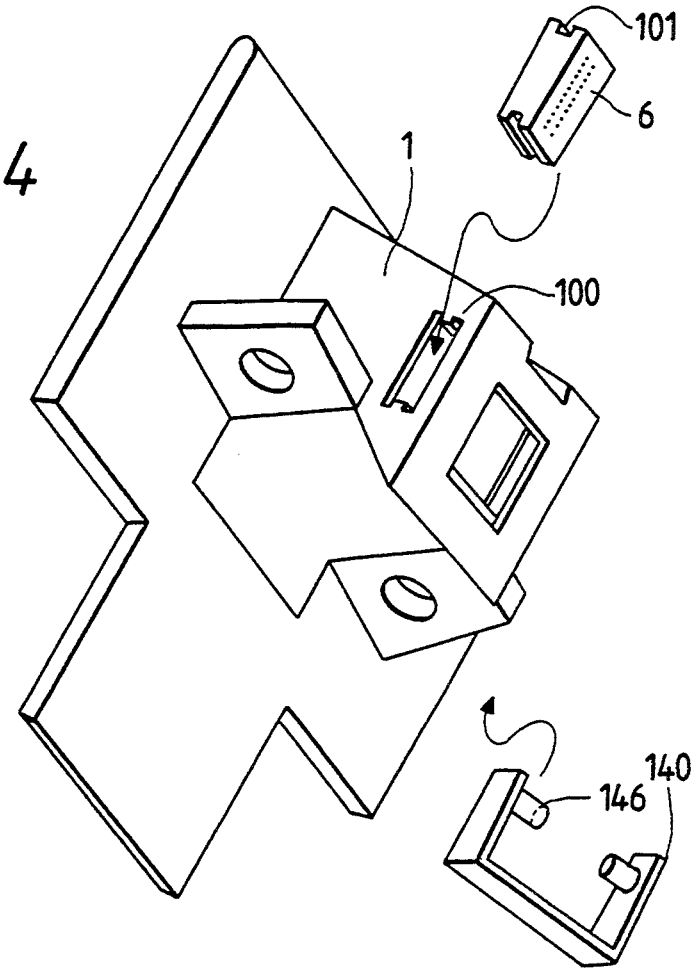
FIG. 44 is an exploded perspective view showing a modified example.

FIG. 44 shows modified examples of the shapes of the front end of the nose as well as of the front end guide. As shown in FIG. 44, a projecting rail 100 is arranged on the nose 1 and a recessed groove 101 is arranged on the front end guide 6, so that the front end guide 6 is slidable. The structure of the modified example is applicable to the above-described sixth embodiment.

Figure 45:
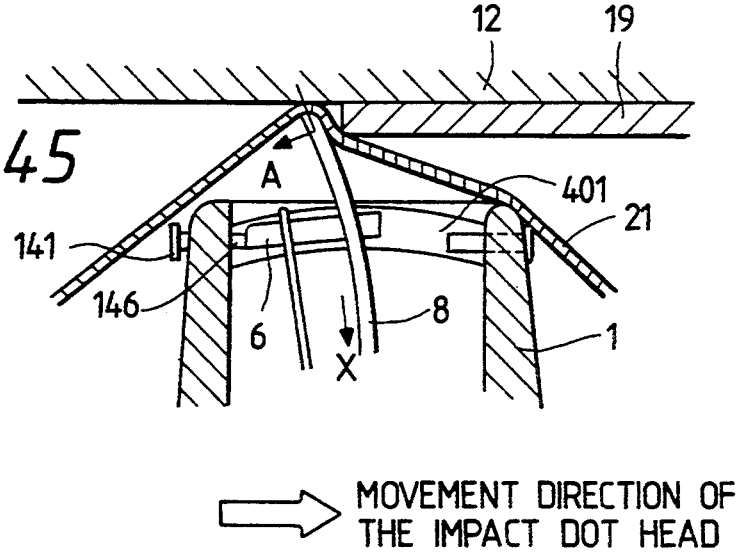
FIG. 45 is a plan view showing a modified example.

FIG. 45 shows another modified example, in which the guide groove 401 is formed into an arc corresponding to a locus of oscillation of the wire 8. The impact dot head moves in the direction of arrow Z.

Such structure allows the front end guide 6 to be slidable with angular displacement. As a result, the wire 8 can return smoothly. The structure, i.e., the shape of the guide groove 401, of this modified example is also applicable to the sixth embodiment.

Eighth Embodiment

Figure 46:
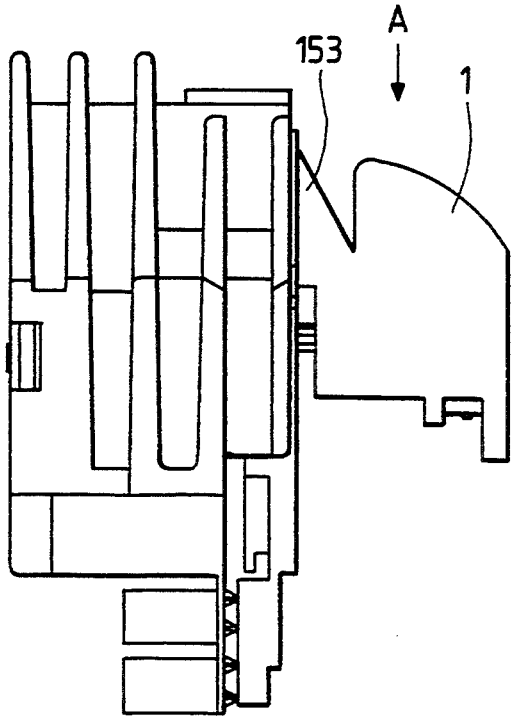
FIG. 46 is a side view showing an impact dot head, which is an eighth embodiment of the invention.
Figure 47:
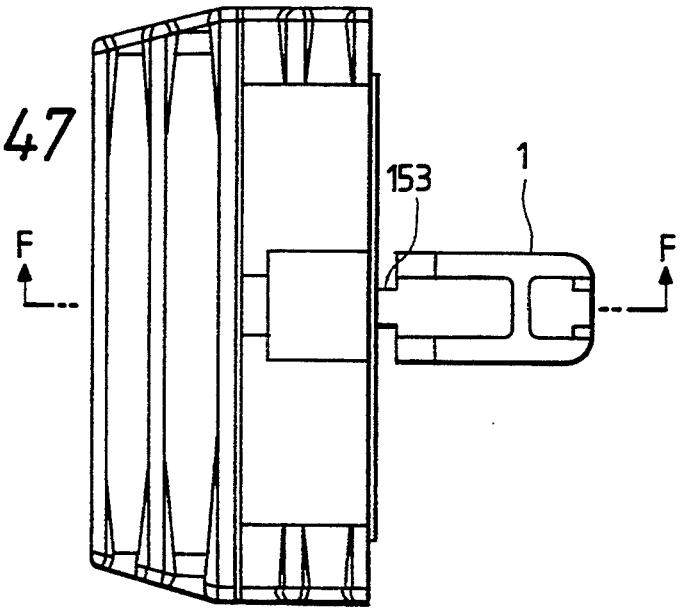
FIG. 47 is a plan view of FIG. 46 as viewed from a position A.

FIG. 46 is a side view showing an impact dot head, which is an eighth embodiment of the invention; FIG. 47 is a plan view of FIG. 46 as viewed from a position A; and FIG. 48 is a sectional view taken along a line F—F of FIG. 47.

The feature of the eighth embodiment over the first embodiment is that the nose 1 has resiliency itself and is oscillatable in the printing digit direction, in contrast to the first embodiment in which it is the nose guide 6 that is oscillatable.

Figure 48:
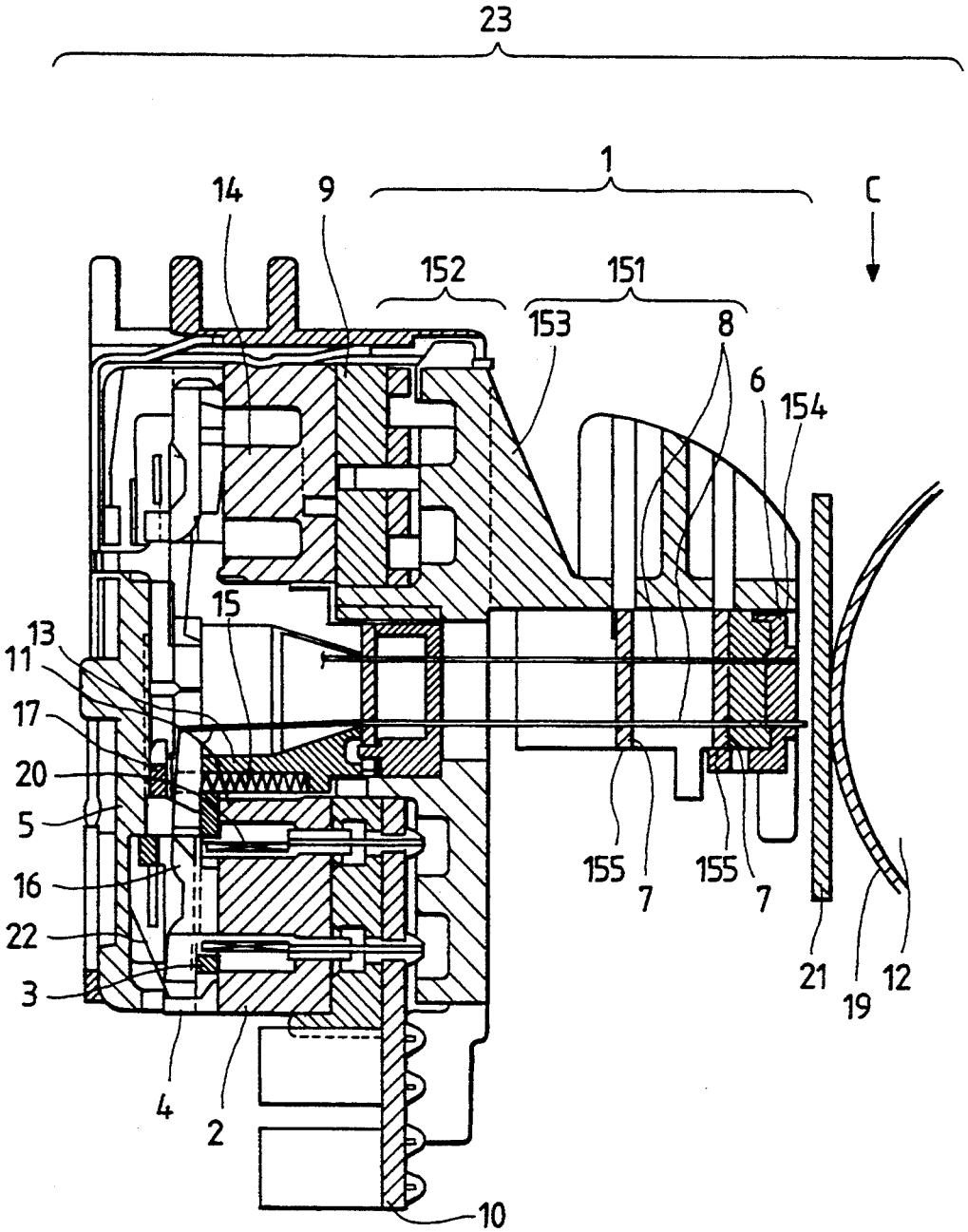
FIG. 48 is a sectional view taken along a line 48—48 FIG. 47.

As shown in FIG. 48, the nose 1 in the eighth embodiment includes a guide supporting portion 151, an insulating member abutting portion 152, and an oscillation spring portion 153, which are formed integrally with one another. The guide supporting portion 151 has a front end guide mounting portion 154 and intermediate guide mounting grooves 155. The front end guide mounting portion 154 holds the front end guide 6, whereas the intermediate guide mounting grooves 155 hold the intermediate guides 7, so that the wires 8 can be arranged at predetermined positions.

The oscillation spring portion 153 is a thin member coupling the guide supporting portion 151 to the insulating member abutting portion 152, which makes the spring 153 less rigid in the vertical direction as viewed in FIG. 47, or in the printing digit direction, and which thus makes the spring 153 easy to deform resiliently. However, the oscillation spring portion 153 is highly rigid in the vertical direction as viewed in FIG. 46, so that the nose 1 does not oscillate in the vertical direction. Such arrangement allows the same operation as fin the first embodiment to be performed. That is, since the nose 1 is oscillatable in the printing digit direction, breakage of wires at the time the head passes the end of the printing sheet can be prevented. In addition, the nose 1 returns to the middle by the resilient force of the oscillation spring portion 153, thereby maintaining high-quality printing.

This embodiment is further provided as giving resiliency to the nose 1 itself so that the nose is oscillatable. Therefore, no additional parts for oscillating the nose 1 are required to achieve the object of the invention as was the case with the first embodiment.

While such a structure that the portion coupling the nose 1 to the head body is made thin to impart resiliency to the nose 1 has been described in this embodiment, structures other than this may be applicable as long as resiliency can be given to the nose 1. For example, if the thickness of a nose forming member is partially reduced to decrease the rigidity, or the entire part of the nose 1 is made of a material easy to deform resiliently such as rubber, the object of the invention can be achieved.

Ninth Embodiment

Figure 49:
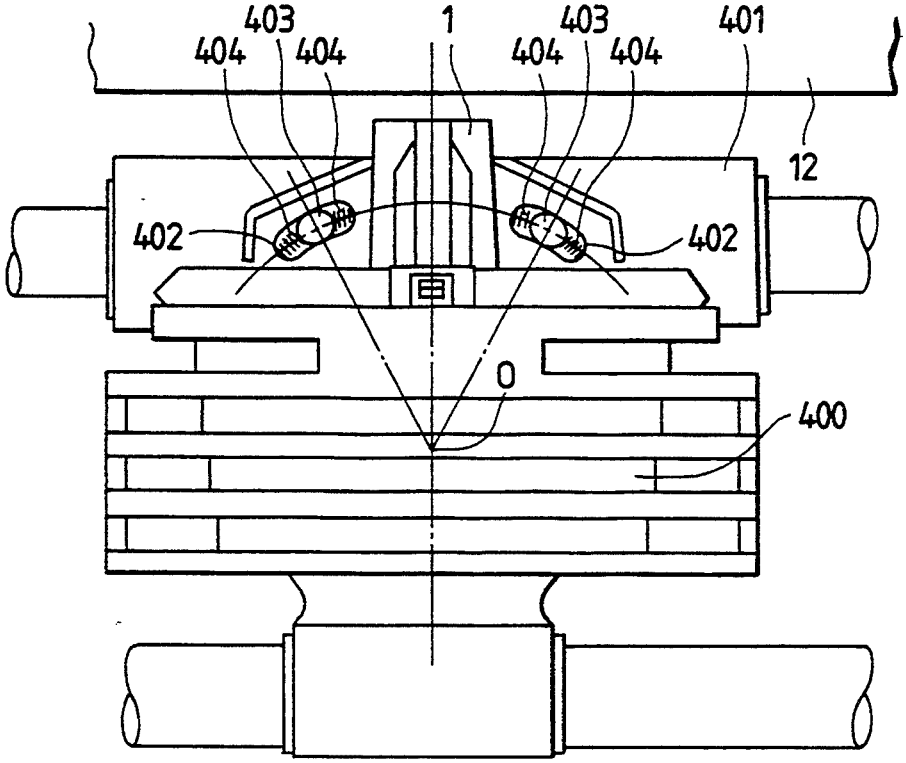
FIG. 49 is a plan view showing an impact dot printer, which is a ninth embodiment of the invention.

FIG. 49 is a plan view showing an impact dot printer, which is a ninth embodiment of the invention.

The ninth embodiment is provided as supporting an impact dot head 400 so as to be resiliently oscillatable in the printing digit direction relative to a carriage 401. Therefore, a head which is different from the one shown in the first embodiment, but which is substantially similar to a conventionally ordinary impact dot head can be used as the head 400.

As shown in FIG. 49, the head 400 is mounted so as to be oscillatable around the center of rotation O relative to the carriage 401 at the bottom thereof.

The nose 1 of the head has arcuate long holes 402, such arcuate long holes being concentric with the center of rotation O. On the other hand, the carriage 401 has cylindrical projecting portions 403, which are fitted into the long holes 402 slidably.

Each long hole 402 further has positioning springs 404, which support the head 400 resiliently so that the center line of the head 400 is substantially perpendicular to a platen 12.

Therefore, the head 400 is resiliently oscillatable in the range in which the projecting portions 403 can move in the long holes 402, and normally confronts the platen directly.

Figure 50:
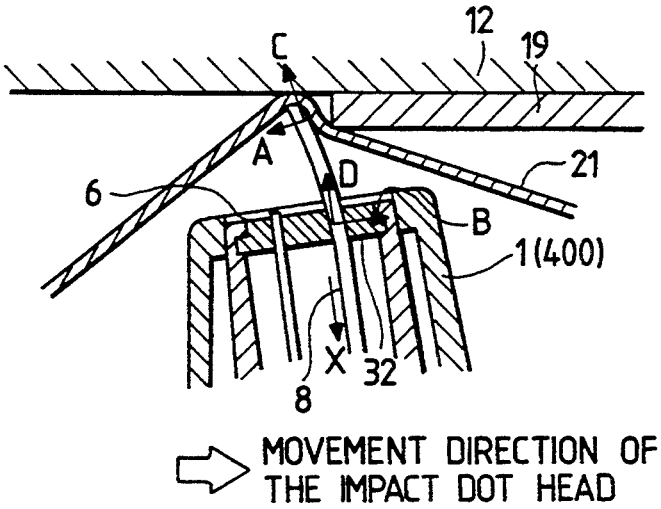
FIG. 50 is a diagram illustrative of the operation thereof.

The thus structured printer performs substantially the same operation as in the first embodiment. That is, since the head 400 is oscillatable in the printing digit direction, breakage of the wire 8 can be prevented by the oscillation of the head against the spring force of the positioning springs 404 even if the wire 8 has collided against the end of the printing sheet 19 as the head passes the end of the printing sheet as shown in FIG. 50. In addition, once the head has passed the end of the printing sheet, the head confronts the platen 12 directly by the resilient force of the positioning springs 404, thereby maintaining high-quality printing.

When the driven direction of the carriage 401 is switched from right to left or from left to right, the positioning springs 404 are flexed by the force due to the inertia of the head 400. If the head 400 oscillates under this condition, the printing quality becomes impaired. To overcome this problem, this embodiment is designed so that the center of rotation O of the head shown in FIG. 49 coincides with the center of gravity of the head 400. With such an arrangement, an inertial moment around the center of rotation O is zeroed. As a result, the head 400 no longer oscillates by the inertial force, thereby contributing to preventing the impairment of the printing quality of the oscillation of the head at the time the carriage 401 switches its movement from right to left or from left to right.

Figure 51:
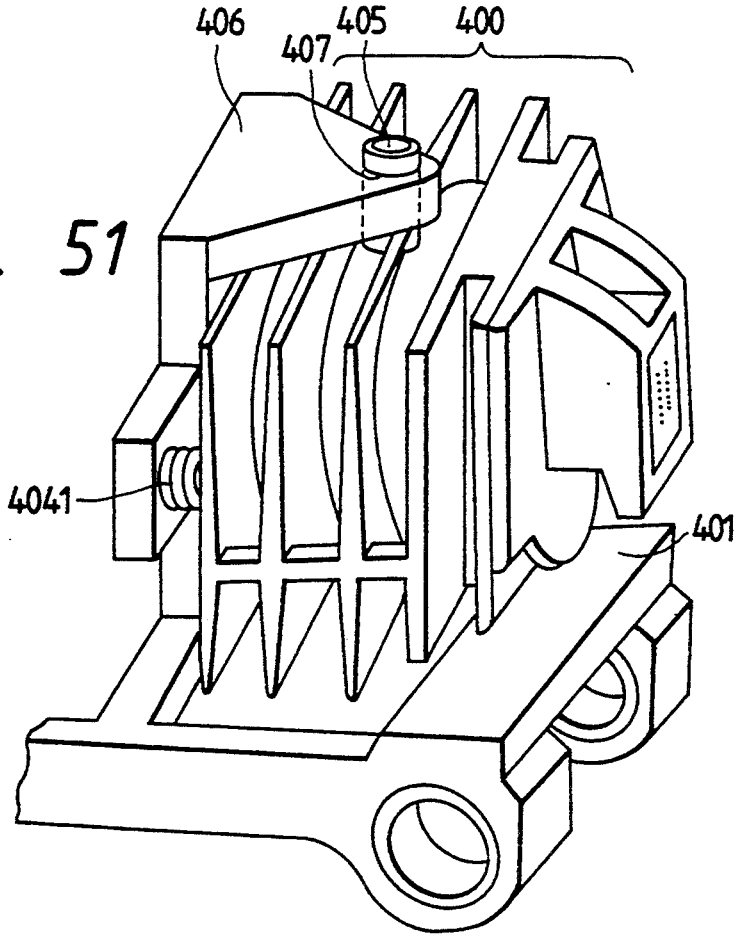
FIG. 51 is a perspective view showing a modified example.

FIG. 51 shows a modified example, in which a member for rotatably supporting the head is formed by arranging a projecting portion 405 at a position corresponding to the center of gravity of the head 400 and fitting the projecting portion 405 into a support hole 407 of a head support member 406 arranged on the carriage 401. In this modified example, a positioning spring 4041 is interposed between each of the right and left sides of the rear end of the head and the head support member 406 so that the head 400 is biased so as to confront the platen directly.

Figure 52:
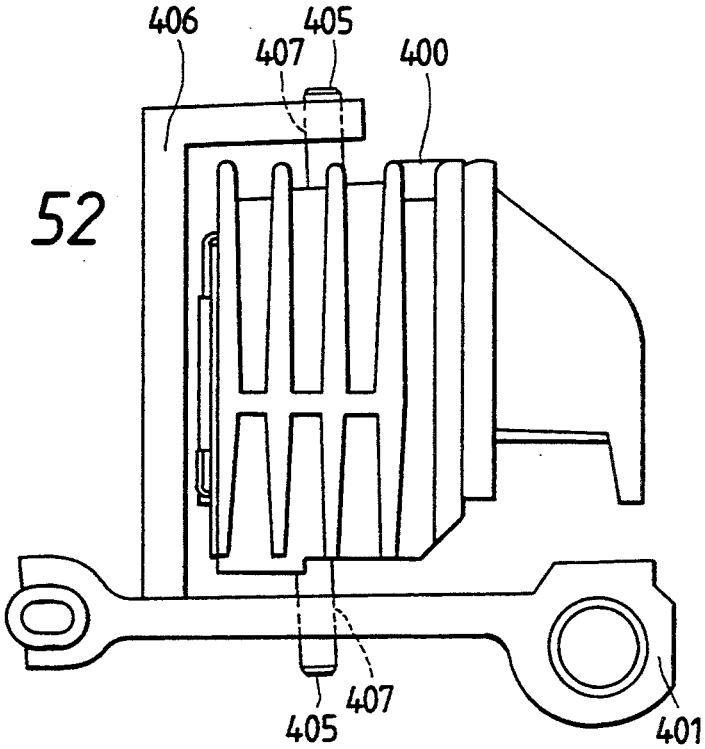
FIG. 52 is a perspective view showing a modified example.

FIG. 52 shows another modified example, in which the projecting portion 405 is utilized as a torsional spring by securing the projecting portion 405 arranged on the head 400 to the support hole 407 of the head support member 406. According to this structure, it is not required to arrange the positioning springs separately, thereby achieving a simplified structure with an advantage of downsizing.

Figure 53:
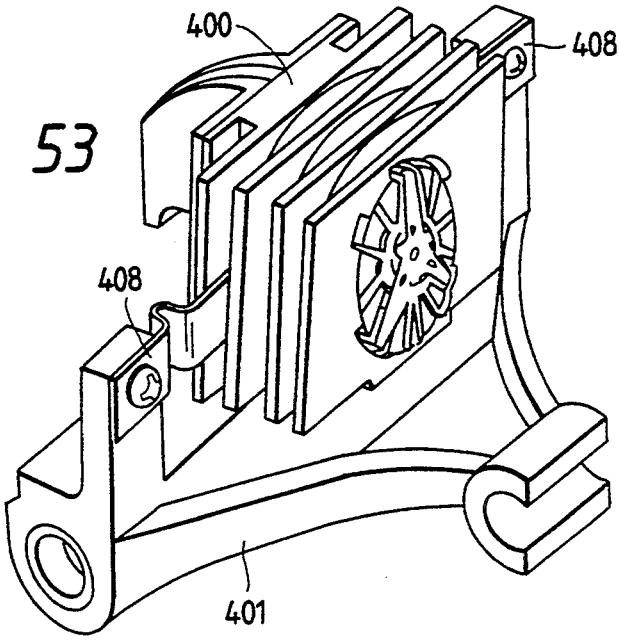
FIG. 53 is a perspective view showing a modified example.
Figure 54:
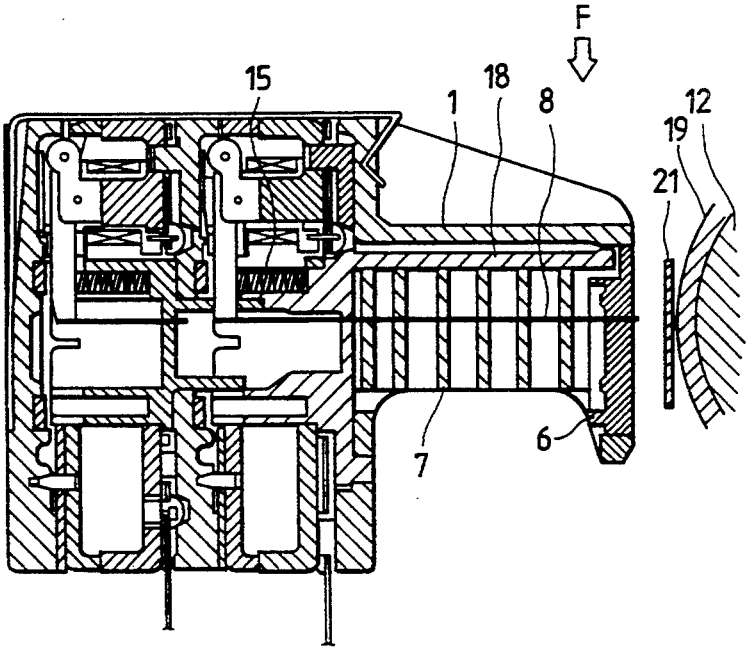
FIG. 54 PRIOR ART
FIG. 54 is a sectional view showing an exemplary conventional impact dot head.
Figure 55:
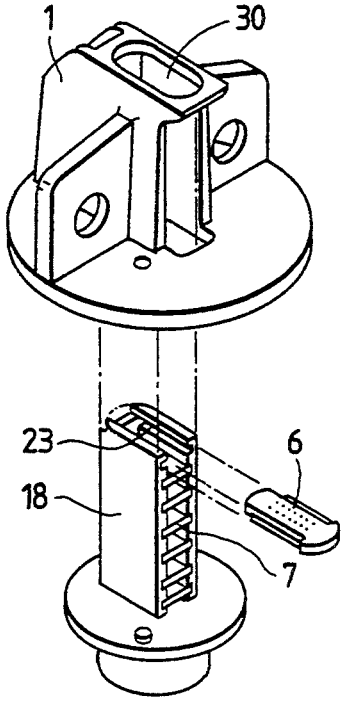
FIG. 55 PRIOR ART
FIG. 55 is an exploded perspective view thereof.
Figure 56:
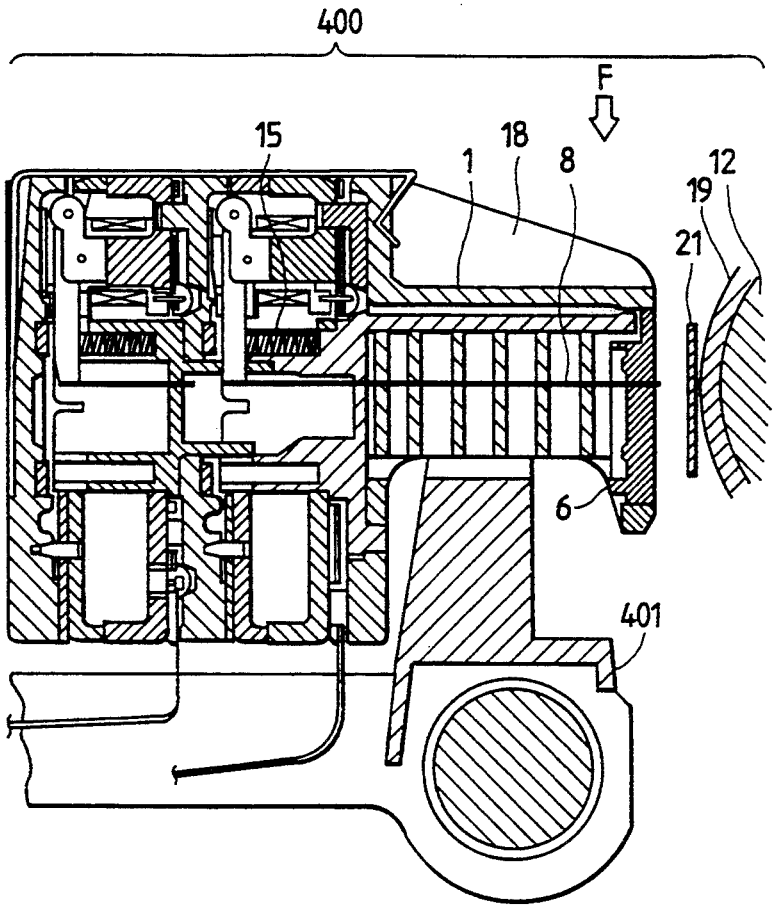
FIG. 56 PRIOR ART
FIG. 56 is a sectional view illustrative of the conventional impact dot printer.
Figure 57:
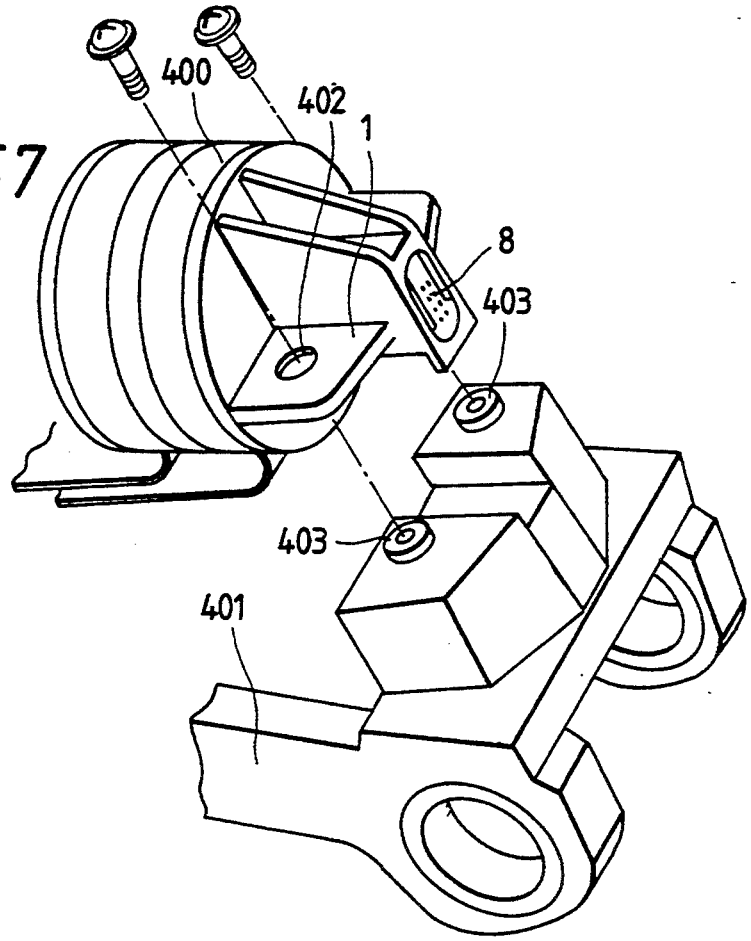
FIG. 57 is a perspective view illustrative of the same.
Figure 58:
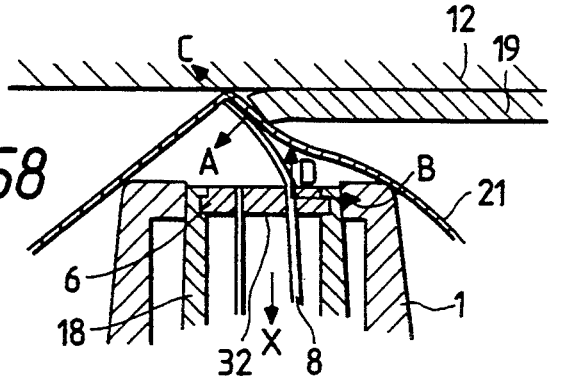
PRIOR ART FIG. 58
FIG. 58 is a plan view of FIG. 54 as viewed from a position F.

FIG. 53 shows still another modified example, in which by arranging a plate spring 408 on the head 400 so that the head 400 is mounted on the carriage 401 through the plate spring 408. This structure allows the head to be supported oscillatably and resiliently by the plate spring 408, thereby achieving a simplified head mounting structure.

While the examples of direct attraction type impact dot head have been described in the first to ninth embodiments, it is apparent that the invention is applicable to spring charge type or piezoelectric type impact dot heads.

What is claimed is:

1. An impact dot head comprising:

a plurality of wires selectively projectable to perform a printing operation while moving in a printing digit direction;.

a nose guide for slidably supporting the wires, the nose guide being supported so as to be oscillatable in the printing digit direction;

a nose for accommodating the nose guide;

a shaft, a nose guide base and a head body;

means for biasing the nose guide so that the nose guide is positioned in the nose;

wherein the nose guide is supported so as to be oscillatable relative to said nose guide base by said shaft, the nose guide base being fixed on said head body.

2. An impact dot head comprising:

a plurality of wires selectively projectable to perform a printing operation while moving in a printing digit direction;

a nose guide for slidably supporting the wires, the nose guide being supported so as to be oscillatable in the printing digit direction;

a nose for accommodating the nose guide;

a shaft and a head body;

means for biasing the nose guide so that the nose guide is positioned in the nose;

wherein the nose guide is supported so as to be oscillatable relative to the nose by said shaft, the nose being fixed on said head body.

3. An impact dot head for printing along a sheet by moving laterally thereacross, said sheet having first and second side edges, comprising:

a plurality of wires selectively projectable to perform a printing operation on said sheet while moving laterally across said sheet in a printing digit direction;

a guide for guiding said wires;

said guide being movably supported so that when one of said wires contacts either of said first or second side edges of said sheet as said head is moved laterally in the printing digit direction, said guide will move to reduce tension on said wire.

4. An impact dot head for printing along a sheet by moving laterally thereacross in both directions, said sheet having first and second side edges, comprising:

a plurality of wires selectively projectable to perform a printing operation on said sheet while moving laterally across said sheet in a printing digit direction;

a nose guide for slidably supporting the wires, the nose guide being supported so as to be movable in the printing digit direction when at least one of said wires contacts either of said first or second side edges of said sheet as said head is moved laterally in the printing digit direction;

a nose for accommodating the nose guide; and means for biasing the nose guide in the nose so that the nose guide is positioned for lateral movement in both lateral directions with respect to the nose.

5. The impact dot head as claimed in claim 4, wherein the biasing means includes a plurality of springs, each of the plurality of springs is arranged between a side surface of the nose guide and an inner surface of the nose.

6. The impact dot head as claimed in claim 4, wherein the biasing means is a plate spring that abuts against an inner surface of the nose and is mounted on the nose guide.

7. The impact dot head as claimed in claim 4, including a front end guide disposed on a front end of the nose guide for supporting the wires so as to be oscillatable, the biasing means including a plurality of resilient arms to abut against the inner surfaces of the nose, and each of said plurality of resilient arms is formed integrally with the front end guide.

8. The impact dot head as claimed in claim 4, wherein the nose guide has a pair of side plates, the biasing means includes tongue-like spring portions and projecting portions, each tongue-like spring portion is formed from an inverted square C-shaped slit on each respective side plates of the nose guide, and each of said projecting portions being formed integrally with each tongue-like spring portion and abutting against an inner surface of the nose.

9. The impact dot head as claimed in claim 4, wherein the biasing means includes a resilient material for closing gaps formed between the nose guide and the nose at a front end portion of the nose guide.

10. An impact dot head for printing along a sheet by moving laterally thereacross, said sheet having first and second side edges, comprising:

a plurality of wires selectively projectable to perform a printing operation on said sheet while moving laterally across said sheet in a printing digit direction; and a nose guide for supporting the wires so as to be oscillatable, the nose guide having resiliency itself and said nose guide being oscillatable so that when one of said wires contacts either of said first or second side edges of said sheet as said head is moved laterally in the printing digit direction, said nose guide will move to reduce tension on said wire.

11. The impact dot head as claimed in claim 10, and including a nose guide base and wherein the nose guide includes a pair of side plates and a guide member, the pair of side plates being formed integrally so as to be flexible relative to said nose guide base in the printing digit direction, the nose guide base fixable on the head, and the wires being supportable on said guide member so as to be oscillatable.

12. The impact dot head as claimed in claim 10, wherein the nose guide includes a pair of side plates and a top plate coupling top portions of the side plates, the top plate being partially integrally coupled to said nose guide base, and the nose guide base being fixed on the head.

13. The impact dot head as claimed in claim 4, wherein a front end portion of the nose includes a first side surface and a second side surface, each of said side surfaces including an opening therethrough.

14. The impact dot head as claimed in claim 10, including a nose for accommodating the nose guide, wherein a front end portion of the nose includes a first side surface and a second side surface, each of said side surfaces including an opening therethrough.

15. The impact dot head as claimed in claim 4, wherein a thin plate is arranged on a front end portion of the nose guide, and the thin plate closes at least one gap between the nose and the front end portion of the nose guide.

16. The impact dot head as claimed in claim 10, including a nose for accommodating the nose guide, wherein a thin plate is arranged on a front end portion of the nose guide, and the thin plate closes at least one gap between the nose and the front end portion of the nose guide.

17. An impact dot head for printing along a sheet by moving laterally thereacross, said sheet having first and second side edges, comprising:

a plurality of wires selectively projectable to perform a printing operation on said sheet while moving laterally across said sheet in a printing digit direction;

a front end guide for supporting the wires so as to be oscillatable;

a nose for supporting the front end guide so as to be movable in the printing digit direction; and biasing means for biasing the front end guide so that when at least one of the wires contacts either of said first or second side edges of said sheet as said head is moved laterally in the printing digit direction, said front end guide will move to reduce tension on said wire.

18. The impact dot head according to claim 17, wherein the biasing means includes resilient arms formed integrally with the front end guide.

19. The impact dot head as claimed in claim 17, wherein the nose is divided into two pieces in the printing digit direction, and the front end guide is movably supported by coupling the two pieces together.

20. The impact dot head as claimed in claim 17, including a thin plate, wherein the front end guide is movably supported in the printing digit direction by both front end of the nose and the thin plate mounted on the front end of the nose from a front side thereof.

21. The impact dot head as claimed in claim 17, including a thin plate, wherein the front end guide is movably supported in the printing digit direction by an inner surface of a front end of the nose and the thin plate mounted on an inner surface of the front end of the nose.

22. An impact dot head according to claim 17, wherein the front end guide is mounted while inserted into a window portion arranged on the front end of the nose, resilient catches are formed integrally with the front end guide, and each resilient catch is arranged for preventing the front end guide from coming out of the window portion.

23. The impact dot head as claimed in claim 17, wherein the biasing means includes a plurality of spacers arranged on each side of the front end guide, and each of said plurality of spacers is interposed between the front end guide and the nose, each of said plurality of spacers being made of a resilient material.

24. The impact dot head as claimed in claim 17, wherein the biasing means includes a front end guide holder mounted on the front end of the nose from outside and said front end guide holder has resiliency.

25. The impact dot head as claimed in claim 17, including a guide groove, wherein the front end guide is guided by said guide groove arranged on the front end of the nose and extending in the printing digit direction, and the guide groove is formed into an arc corresponding to a locus of oscillation of said plurality of wires.

26. An impact dot head for printing along a sheet by moving laterally thereacross, said sheet having first and second side edges, comprising:

a plurality of wires selectively projectable to perform a printing operation on said sheet while moving laterally across said sheet in a printing digit direction; and a nose for supporting the wires so as to be oscillatable, said nose having resilience itself and being oscillatable so that when one of said wires contacts either of said first or second side edges of said sheet as said head is moved laterally in the printing digit direction, said nose will move to reduce tension in the wire.

27. An impact dot printer for printing along a sheet by moving laterally thereacross, said sheet having first and second side edges, comprising:

an impact dot head including:

a plurality of wires selectively projectable to perform a printing operation on said sheet while moving laterally across said sheet in a printing digit direction; and a carriage for supporting the impact dot head and laterally moving the impact dot head, and for permitting said impact dot head to be oscillatable so that when one of said wires contacts either of said first or second side edges of said sheet as said head is moved laterally in the printing digit direction, said head will move to reduce tension in the wire.

* * * * *